US007063802B2

(12) United States Patent
Tsuda et al.

(10) Patent No.: US 7,063,802 B2
(45) Date of Patent: Jun. 20, 2006

(54) COMPOSITION AND METHOD OF MAKING AN ELEMENT-MODIFIED FERROFLUID

(75) Inventors: Shiro Tsuda, Asahi (JP); Koji Nemoto, Asahi (JP); Nobuharu Iijima, Choshi (JP); Nobuaki Kurihara, Choshi (JP)

(73) Assignee: Ferrotec Corporation, Tokyo (JP)

( * ) Notice: Subject to any disclaimer, the term of this patent is extended or adjusted under 35 U.S.C. 154(b) by 0 days.

(21) Appl. No.: 10/402,527

(22) Filed: Mar. 28, 2003

(65) Prior Publication Data

US 2004/0195540 A1 Oct. 7, 2004

(51) Int. Cl.
*H01F 1/44* (2006.01)

(52) U.S. Cl. ..... 252/62.52; 252/62.55

(58) Field of Classification Search ..... 252/62.52, 252/62.55

See application file for complete search history.

(56) References Cited

U.S. PATENT DOCUMENTS

| | | | | |
|---|---|---|---|---|
| 3,843,540 | A | 10/1974 | Reimers et al. | |
| 4,100,088 | A * | 7/1978 | Haas et al. | 252/62.52 |
| 4,103,103 | A * | 7/1978 | Hizikata | 174/140 C |
| 4,554,088 | A | 11/1985 | Whitehead et al. | |
| 4,604,229 | A * | 8/1986 | Raj et al. | 252/510 |
| 4,938,886 | A | 7/1990 | Lindsten et al. | |
| 4,956,113 | A | 9/1990 | Kanno et al. | |
| 4,976,883 | A | 12/1990 | Kanno et al. | |
| 5,013,471 | A | 5/1991 | Ogawa | |
| 5,064,550 | A | 11/1991 | Wyman | |
| 5,143,637 | A | 9/1992 | Yokouchi et al. | |
| 5,415,906 | A * | 5/1995 | Miyakawa et al. | 428/35.7 |
| 5,549,837 | A * | 8/1996 | Ginder et al. | 252/62.52 |
| 5,676,877 | A | 10/1997 | Borduz et al. | |
| 5,769,996 | A * | 6/1998 | McArdle et al. | 156/272.4 |

FOREIGN PATENT DOCUMENTS

| | | | |
|---|---|---|---|
| JP | 3-95298 | * | 4/1991 |

* cited by examiner

*Primary Examiner*—C. Melissa Koslow
(74) *Attorney, Agent, or Firm*—Robert R. Deleault, Esq.; Mesmer & Deleault, PLLC

(57) ABSTRACT

An element-modified ferrofluid comprising a base oil, a plurality of magnetic particles covered with at least one surfactant, and an elemental modifier. The elemental modifier is a metal, a metal mixture, an alloy, or a nonmetal.

36 Claims, No Drawings

COMPOSITION AND METHOD OF MAKING AN ELEMENT-MODIFIED FERROFLUID

BACKGROUND OF THE INVENTION

1. Field of the Invention

The present invention relates to magnetic fluids and a process for preparing the same. Particularly, the present invention relates to a magnetic fluid composition having an improved chemical stability and the process for preparing the same.

2. Description of the Prior Art

Magnetic fluids, sometimes referred to as "ferrofluids" or magnetic colloids, are colloidal dispersions or suspensions of finely divided magnetic or magnetizable particles ranging in size between thirty and one hundred fifty angstroms and dispersed in a carrier liquid. One of the important characteristics of magnetic fluids is their ability to be positioned and held in space by a magnetic field without the need for a container. This unique property of magnetic fluids has led to their use for a variety of applications. One such use is their use as liquid seals with low drag torque where the seals do not generate particles during operation as do conventional seals. These liquid seals are widely used in computer disc drives as exclusion seals to prevent the passage of airborne particles or gases from one side of the seal to the other. In the environmental area, environmental seals are used to prevent fugitive emissions, that is emissions of solids, liquids or gases into the atmosphere, that are harmful or potentially harmful.

Other uses of magnetic fluids are as heat transfer fluids between the voice coils and the magnets of audio speakers, as damping fluids in damping applications and as bearing lubricants in hydrodynamic bearing applications. Yet another is their use as pressure seals in devices having multiple liquid seals or stages such as a vacuum rotary feedthrough seal. Typically, this type of seal is intended to maintain a pressure differential from one side of the seal to the other while permitting a rotating shaft to project into an environment in which a pressure differential exists.

The magnetic particles are generally fine particles of ferrite prepared by pulverization, precipitation, vapor deposition or other similar means. From the viewpoint of purity, particle size control and productivity, precipitation is usually the preferred means for preparing the ferrite particles. The majority of industrial applications using magnetic fluids incorporate iron oxides as magnetic particles. The most suitable iron oxides for magnetic fluid applications are ferrites such as magnetite and γ-ferric oxide, which is called maghemite. Ferrites and ferric oxides offer a number of physical and chemical properties to the magnetic fluid, the most important of these being saturation magnetization, viscosity, magnetic stability, and chemical stability of the whole system. To remain in suspension, the ferrite particles require a surfactant coating, also known as a dispersant to those skilled in the art, in order to prevent the particles from coagulating or agglomerating. Fatty acids, such as oleic acid, have been used as dispersing agents to stabilize magnetic particle suspensions in some low molecular-weight non-polar hydrocarbon liquids. These low molecular-weight non-polar hydrocarbon liquids are relatively volatile solvents such as kerosene, toluene and the like. Due to their relative volatility, evaporation of these volatile hydrocarbon liquids is an important drawback as it deteriorates the function of the magnetic fluid itself. Thus to be useful, a magnetic fluid must be made with a low vapor-pressure carrier liquid and not with a low-boiling point hydrocarbon liquid.

The surfactants/dispersants have two major functions. The first is to assure a permanent distance between the magnetic particles to overcome the forces of attraction caused by Van der Waal forces and magnetic attraction, i.e. to prevent coagulation or agglomeration. The second is to provide a chemical composition on the outer surface of the magnetic particle that is compatible with the liquid carrier.

The saturation magnetization (G) of magnetic fluids is a function of the disperse phase volume of magnetic materials in the magnetic fluid. In magnetic fluids, the actual disperse phase volume is equal to the phase volume of magnetic particles plus the phase volume of the attached dispersant. The higher the magnetic particle content, the higher the saturation magnetization. The type of magnetic particles in the fluid also determines the saturation magnetization of the fluid. A set volume percent of metal particles in the fluid such as cobalt and iron generates a higher saturation magnetization than the same volume percent of ferrite. The ideal saturation magnetization for a magnetic fluid is determined by the application. For instance, saturation magnetization values for exclusion seals used in hard disk drives are typically lower than those values for vacuum seals used in the semiconductor industry.

The viscosity of the magnetic fluid is a property that is preferably controlled since it affects the suitability of magnetic fluids for particular applications. The viscosity of magnetic fluids may be predicted by principles used to describe the characteristics of an ideal colloid. According to the Einstein relationship, the viscosity of an ideal colloid is $$(N/N_0)=1+\alpha\Phi$$

where N=colloid viscosity $N_0$=carrier liquid viscosity

α=a constant; and

Φ=disperse phase volume

Gel time is a function of the life expectancy of the magnetic fluid. A magnetic fluid's gel time is dependent on various factors including temperature, viscosity, volatile components in the carrier liquid and in the dispersants, and saturation magnetization. Evaporation of the carrier liquid and oxidative degradation of the dispersant occurs when the magnetic fluid is heated. Oxidative degradation of the dispersant increases the particle-to-particle attraction within the colloid resulting in gelation of the magnetic colloid at a much more rapid rate than would occur in the absence of oxidative degradation.

Most of the magnetic fluids employed today have one to three types of surfactants arranged in one, two or three layers around the magnetic particles. The surfactants for magnetic fluids are long chain molecules having a chain length of at least sixteen atoms such as carbon, or a chain of carbon and oxygen, and a functional group at one end. The chain may also contain aromatic hydrocarbons. The functional group can be cationic, anionic or nonionic in nature. The functional group is attached to the outer layer of the magnetic particles by either chemical bonding or physical force or a combination of both. The chain or tail of the surfactant provides a permanent distance between the particles and compatibility with the liquid carrier.

Various magnetic fluids and the processes for making the same have been devised in the past. The oil-based carrier liquid is generally an organic molecule, either polar or nonpolar, of various chemical compositions such as hydrocarbon (polyalpha olefins, aromatic chain structure molecules), esters (polyol esters), silicone, or fluorinated and other exotic molecules with a molecular weight range up to about eight to nine thousand. Most processes use a low boiling-point hydrocarbon solvent to peptize the ferrite particles. To evaporate the hydrocarbon solvent from the resultant oil-based magnetic fluid in these processes, all of these processes require heat treatment of the magnetic fluid at about 70° C. and higher or at a lower temperature under reduced pressure. Because there are a number of factors that affect the physical and chemical properties of the magnetic fluids and that improvements in one property may adversely affect another property, it is difficult to predict the effect a change in the composition or the process will have on the overall usefulness of a magnetic fluid. It is known in the art that magnetic fluids in which one of the dispersants is a fatty acid, such as oleic, linoleic, linolenic, stearic or isostearic acid, are susceptible to oxidative degradation of the dispersant system. This results in gelation of the magnetic fluid.

U.S. Pat. No. 5,676,877 (1997, Borduz et al.) teaches a composition and a process for producing a chemically stable magnetic fluid having finely divided magnetic particles covered with surfactants. A surface modifier is also employed which is added to cover thoroughly the free oxidizable exterior surface of the outer layer of the particles to assure better chemical stability of the colloidal system. The surface modifier is an alkylalkoxide silane.

U.S. Pat. No. 5,013,471 (1991, Ogawa) teaches a magnetic fluid, a method of production and a magnetic seal apparatus using the magnetic fluid. The magnetic fluid has ferromagnetic particles covered with a monomolecular adsorbed film composed of a chloro-silane type surfactant having a chain with ten to twenty-five atoms of carbon. Fluorine atoms are substituted for the hydrogen atoms of the hydrocarbon chain of the chlorosilane surfactant used in this process. According to this reference, the chlorosilane surfactant has to be large enough to disperse the particles and to assure the colloidal stability of the magnetic fluid by providing sufficient distance between the particles.

U.S. Pat. No. 5,143,637 (1992, Yokouchi et al.) teaches a magnetic fluid consisting of ferromagnetic particles dispersed in an organic solvent, a low molecular weight dispersing agent, and an additive with a carbon number between twenty-five and fifteen hundred. The low molecular weight dispersing agent is used to disperse the particles in an organic carrier. In the summary of this reference, there is a discussion about using a coupling agent, such as silane, as a dispersant. However, the coupling agent has to have a large enough molecular weight to perform as a dispersant. It should be mentioned that, in U.S. Pat. No. 5,143,637, there is no particular disclosure claim directed to using silane as an additive or even as a dispersant. The thermal stability of the fluid is increased by adding a high molecular weight additive, e.g. up to twenty thousand, such as polystyrene, polypropylene, polybutene, or polybutadiene polymers.

U.S. Pat. No. 4,554,088 (1985, Whitehead et al.) teaches use of a polymeric silane as a coupling agent. The coupling agents are a special type of surface-active chemicals that have functional groups at both ends of the long chain molecules. One end of the molecule is attached to the outer oxide layer of the magnetic particles and the other end of the molecule is attached to a specific compound of interest in those applications, such as drugs, antibodies, enzymes, etc.

U.S. Pat. No. 5,064,550 (1991, Wyman) teaches a superparamagnetic fluid having a non-polar hydrocarbon oil carrier liquid and coated magnetic particles. The magnetic particles are coated with at least one acid selected from the group consisting of an organic acid containing only carbon and hydrogen atoms in the chain connected to the carboxyl group. The chain contains at least 19 carbon atoms and an amino acid acylated with a fatty acid. There is also disclosed a method of making a superparamagnetic fluid which includes providing an aqueous suspension of coated magnetic particles coated with at least one acid selected from the group consisting of an organic acid where the chain connected to the carboxyl group contains at least 19 carbon atoms and an amino acid acylated with a fatty acid.

U.S. Pat. No. 4,976,883 (1990, Kanno et al.) teaches a process for preparing a magnetic fluid. The magnetic fluid contains fine particles of surfactant-coated ferrite stably dispersed in a carrier liquid. The surfactant, or first dispersant, to be adsorbed on the fine particles of ferrite is one of those usually used for dispersing fine particles into a hydrocarbon solvent, preferably higher fatty acid salts and sorbitan esters. The dispersing agent used is selected from N-polyalkylenepolyamine-substituted alkenylsuccinimide, an oxyalkylene-substituted phosphoric acid ester and a nonionic surfactant.

U.S. Pat. No. 4,956,113 (1990, Kanno et al.) teaches a process for preparing a magnetic fluid. The magnetic fluid contains fine particles of ferrite stably dispersed in a low vapor pressure base oil. The magnetic fluid is prepared by adding N-polyalkylenepolyamine-substituted alkenylsuccinimide to a suspension of fine particles of surfactant-adsorbed ferrite dispersed in a low boiling-point hydrocarbon solvent. The surfactant adsorbed on the fine particles of ferrite is one of those usually used for dispersing fine particles into a hydrocarbon solvent, preferably higher fatty acid salts and sorbitan esters. The mixture is heated to remove the hydrocarbon solvent followed by the addition of a low vapor-pressure base oil and a specific dispersing agent. The resultant mixture is subjected to a dispersion treatment.

U.S. Pat. No. 4,938,886 (1990, Lindsten et al.) teaches a superparamagnetic liquid having magnetic particles in a stable colloidal suspension, a dispersant and a carrier liquid. The dispersant has a structure A-X-B where A is derived from a nonionic surface active agent, B is a carboxylic acid group and X is a connecting group between A and B. The carrier liquid is a thermodynamically good solvent for A but which does not form a stable superparamagnetic liquid with magnetic particles coated only with oleic acid.

U.S. Pat. No. 3,843,540 (1974, Reimers et al.) teaches the production of magnetic fluids using peptizing techniques. The magnetic fluids are produced by reacting an aqueous solution of iron salts with a base to produce a precipitate of colloidal-sized, ferrimagnetic iron oxide particles. The particles are coated with an adsorbed layer of water soluble, but decomposable, dispersing agent. The coated particles are then decomposed to a non-water soluble form and dispersed into a non-aqueous carrier liquid.

None of the prior art proposes or suggests the use of metal, metal mixtures, alloys, or nonmetal elements as magnetic fluid modifiers in magnetic fluids for increasing a magnetic fluid's stability.

Therefore, what is needed is a magnetic fluid that has a metal, metal mixture, alloy, or nonmetal-based magnetic fluid modifier added to the magnetic fluid for increasing a magnetic fluid's stability. What is further needed is a hydrocarbon-based or ester-based magnetic fluid that has a metal, metal mixture, alloy, or nonmetal-based magnetic fluid modifier added to the magnetic fluid for increasing a magnetic fluid's stability. Finally what is needed is a process for making a hydrocarbon-based, an ester-based or a silicone-based magnetic fluid that has increased stability.

SUMMARY OF THE INVENTION

It is an object of the present invention to provide a magnetic fluid that has a metal, metal mixture, alloy, or nonmetal-based magnetic fluid modifier added to the magnetic fluid, giving the magnetic fluid increased stability. It is a further object of the present invention to provide a hydrocarbon-based, an ester-based or a silicone-based magnetic fluid that has a metal, metal mixture, alloy, or nonmetal-based magnetic fluid modifier added to the magnetic fluid giving the magnetic fluid increased stability. It is still a further object of the present invention to provide a process for making a hydrocarbon-based, an ester-based or a silicone-based magnetic fluid that has increased stability.

The present invention achieves these and other objectives by providing a magnetic fluid and a process for making a magnetic fluid where the magnetic fluid's resistance to oxidative attack is enhanced.

A magnetic fluid has to exhibit stability in two areas in order to be used in current industrial applications. The first is to have colloidal stability under a very high magnetic field gradient. The magnetic particles tend to agglomerate and aggregate under high magnetic field gradients and separate out from the rest of the colloid. The second is to have chemical stability relating to oxidation of the surfactant and the organic oil carrier. All the organic oils undergo a slow or rapid oxidation process over the course of time. This results in an increased viscosity of the oil to the point where the oil becomes a gel or solid.

Magnetic fluids made according to the prior art all have relatively short gelation times when exposed to oxidative degradation. Magnetic fluids of the present invention, however, have much longer useful lives when exposed to oxidative degradation. It was unexpected and surprising to discover that the gelation times, that is the useful life of the magnetic fluids, were greatly enhanced by a factor of about 10% and higher, depending on the application, over magnetic fluids made using no metal, metal mixture, alloy, or nonmetal-based modifier.

The present invention provides for a magnetic fluid composed of magnetic particles coated with a surfactant to which is added a metal, metal mixture, alloy, or nonmetal as a magnetic fluid modifier. The magnetic fluid of the present invention is made up of four components, namely an oil carrier liquid, one or more of an organic surfactant/dispersant, a metal, metal mixture, alloy, or nonmetal-based modifier, and fine magnetic particles where the modifier has an element purity in the range of 10% to about 99%.

It is unknown how the addition of metal, metal mixture, alloy, or nonmetal increases the useful life of a magnetic fluid. One theory is that small particles of the metal, metal mixture, alloy, or nonmetal-based modifier covers the area not covered by the surfactant used in the preparation of the magnetic fluid. The surfactant has a relatively long tail, which allows the surfactant coated magnetic particles to be dispersed in an organic solvent and/or in an oil-based carrier fluid. It is believed that the magnetic fluid elemental modifier penetrates to the uncovered oxidizable surface of the magnetic particles through the tail of the surfactants already connected to that surface. It may cover the surface and protect the surface against oxidative attack, but this is uncertain.

It is equally plausible that the elemental modifier exists in the oil-based carrier and acts in a way similar to that of a "buffer." In other words, the elemental modifier undergoes oxidative degradation more easily than the magnetic particles. This may be because the elemental modifier, unlike the magnetic particles, does not have any dispersant coating protecting its surface. Thus, the elemental modifier acts as an oxygen absorber. This, however, is pure conjecture regarding how the elemental modifier improves the useful life of the ferrofluids.

A quantity, by weight, of elemental modifier, is added to the hydrocarbon-based, ester-based or silicone-based ferrofluid having low volatility and low viscosity. The ferrofluid with elemental modifier undergoes an "aging" process, i.e. treatment, for a certain period of time such as, for example, from about 2 days to about 80 days but may be any period of time. After treatment, excess elemental modifier is separated from the treated ferrofluid. The "aging" process may be at room temperature and room relative humidity, or it may be at elevated temperature and relative humidity such as, for example, at about 60° C. to about 90° C. and a relative humidity of about 90% but may be any combination of temperature and elevated relative humidity.

The treated magnetic fluid is then subjected to an oxidative environment. A quantity of treated magnetic fluid is added to several glass dishes/vials. The dishes/vials are placed in an elevated temperature environment to shorten the test period.

Typically, magnetic fluids made without the elemental modifier but having been subjected to aging at room temperature and relative humidity will continue to function for a reasonable time period depending on the type of ferrofluid when continually operated at 150° C. before gelation begins to occur. Magnetic fluids made in accordance with the present invention are capable of operating at 150° C. for longer periods of time as compared to their untreated equivalents.

It was unexpected and surprising to discover that the gelation times, that is the useful life of the magnetic fluids, were greatly enhanced by a factor of about 8–10% and higher, depending on the type of magnetic fluid, over untreated magnetic fluids. The treated magnetic fluid was much more resistant to oxidative degradation than untreated magnetic fluid. Typically, the treated magnetic fluid has 1.1 to 5 times better resistance to oxidative degradation than the untreated magnetic fluid.

Additional advantages and embodiments of the invention will be set forth in part in the detailed description that follows, and in part will be apparent from the description, or may be learned by practice of the invention. It is understood that the foregoing general description and the following detailed description are exemplary and explanatory and are intended to provide further explanation of the invention as claimed.

DETAILED DESCRIPTION OF THE PREFERRED EMBODIMENT

Repeated experiments show that oil undergoes a faster oxidation in contact with a solid surface, especially oxides. Mixing the oil with very small size magnetic particles significantly reduces the life of the oil. A simple calculation shows that a cubic centimeter of magnetic fluid of two hundred gauss (200 G) (20 millitesla) saturation magnetization has around ten to the sixteenth power ($10^{16}$) number of magnetic particles of one hundred angstrom diameter. The total outer surface area of these magnetic particles is estimated to be about thirty square meters. This represents only an approximation of the surface area of the magnetic particles that is susceptible to oxidation in a cubic centimeter of magnetic fluid. The area could be much larger considering that the surface of the outer area is not uniform but has a topography of "mountains and valleys." Because of steric repulsion and geometry, the surfactant will theoretically cover at best eighty to ninety percent of the outer area of the particles. There is about three to six square meters of uncovered outer area in contact with a very small amount of oil. This simple calculation shows that the major oxidation effect of the oil and surfactant is due to the immense surface of oxide from the uncovered surface area of the particles.

The present invention uses an elemental modifier to add to the magnetic fluid. The mechanism responsible for the improved magnetic fluid life is unknown. However, it is theorized that element particles of the elemental modifier penetrate to the uncovered surface of the magnetic particles through the tails of the existing surfactant. The element may be adsorbed to the surface of the particles or it may provide a line of defense that undergoes oxidative degradation before the magnetic particles. Because the surfactant is adsorbed to the surface of the magnetic particles, the integrity of the surfactant/magnetic particle interaction is not compromised, which, in turn, extends the life of the magnetic fluid. The elemental modifier may act as a sacrificial element that takes the oxidative attack for a time before becoming "oxygen saturated" and allowing oxidative attack to penetrate to the magnetic particles. On the other hand, the elemental modifier may act more like a sponge, adsorbing the oxidative attack and preventing the oxidative attack from degrading the surfactant/magnetic particle interface. These methods of action are purely conjecture on the part of the inventors. No matter the underlying mechanism, the addition of a metal, metal mixture, alloy, or nonmetal-based modifier to a hydrocarbon-based, an ester-based or a silicone-based magnetic fluid increases the useful life of magnetic fluids.

The elemental modifier used by the present invention comprises metal, metal mixtures, alloys, or nonmetals.

The magnetic fluid of the present invention is made up of four components, namely an oil carrier liquid, one or more of an organic surfactant/dispersant, an elemental modifier, and fine magnetic particles. Generally, the magnetic fluid with one or more surfactants are treated with the elemental modifier by directly adding the elemental modifier to the ferrofluid containing the magnetic particles.

In the following procedures and examples, it is generally assumed that the higher the reaction temperature, the faster the reaction. Although a variety of reaction temperatures have not been tested, it is assumed that the reaction times would vary inversely with the reaction temperature.

General Procedure

A number of ferrofluids were treated with a variety of elemental modifiers. The treatment, also culled "aging" was carried out under various conditions of temperature and relative humidity for a period of time. After the aging/conditioning treatment, the treated ferrofluids underwent degradation tests under dry conditions and at elevated temperatures. The examples and tables below indicate the treatment and degradation parameters used for the aging and testing of the indicated ferrofluids. In all tests, a normal sample, i.e. a sample of the ferrofluid that was not subjected to the treatment/aging process except for aging at room temperature and room relative humidity, was also tested to compare the improvement in useful life of treated ferrofluids versus untreated ferrofluids. It should be understood that the temperature and relative humidity conditions are all made at about the listed temperature and about the listed relative humidity.

Procedure for Treating Ferrofluid

Samples of the various types of ferrofluid were poured and weighed in glass dishes having an inside diameter of approximately 12.9 mm, an outside diameter of approximately 15 mm and a length of approximately 10 mm. Sufficient ferrofluid was poured into the glass dishes such that the fluid thickness was about 3 mm. Approximately 0.04 grams (about 10% by weight to the weight of the ferrofluid) of each tested metal, metal mixture, alloy, or nonmetal (collectively the "elemental modifier") was added to each dish and mixed except for the dish containing ferrofluid used as the control, i.e. the comparative sample. The dishes containing the elemental modifier/ferrofluid mixture were then subjected to certain conditions of temperature and relative humidity for a period of time (the aging process).

The conditions used for a particular type of ferrofluid are stated in the examples and tables. After aging, the ferrofluid samples were then subjected to oxidative degradation tests, i.e. gel test.

Gel Test Procedure

The treated ferrofluid samples are respectively placed in a glass dish having an inside diameter of about 12.9 mm, an outside diameter of about 15.0 mm and a length of about 10.0 mm. A sufficient volume of magnetic fluid is added to each dish so that the thickness of the magnetic fluid in the glass dish is about 3 mm. The glass dishes are placed in a hole-drilled aluminum plate (260 mm×290 mm×7.7 mm), the holes being sized such that the glass dishes fit snugly. The aluminum plate is then place in an oven at a controlled temperature of about 130±3° C., about 150±3° C. or about 170±3° C., depending on the temperature at which a particular test is performed. The glass dishes are periodically removed from the oven, cooled to room temperature for one to two hours and examined for signs of gel formation. A small magnet is placed at the meniscus of the fluid in the dish. When the material was no longer attracted to the portion of the magnet held above the meniscus, the magnetic fluid was considered to have gelled.

EXAMPLE 1

Two varieties of nickle powder were used in the treatment procedure for its effect on the useful life of four different ferrofluids. The nickle powder is available from Yamaishi Metals Corp., 2-3-11 Shinkawa Chuo-ku, Tokyo, Japan as catalog number 200 ($P_1$) and catalog number 255 ($P_2$). $P_1$ has an average metal particle size of 44 microns (μm) and 99% purity. $P_2$ has an average metal particle size of 2.2–2.8 microns (μm) and 99% purity. Samples of each ferrofluid were treated and aged for each type of nickle powder. Each sample type was tested for effectiveness when treated with 5 wt. percent of nickle and 10 wt. percent of nickle. The four ferrofluids differ from one another either in the material used as the carrier liquid or in the dispersant used to coat the magnetic particles of the ferrofluid. The carrier liquid is either a polar or nonpolar liquid such as a poly α-olefin, a mixture of diester and alkylnaphthalene, or a mixture of diester and trimellitate ester. The forrofluids are available from Ferrotec Corporation. Tokyo, Japan under the catalog numbers CSG26 (poly α-olefin), CSG24A (poly α-olefin), CSG33 (diester+alkylnapthalene), and CFF100A (diester+trimellitate ester). The ferrofluids were treated using the treatment procedure previously mentioned and then tested for oxidative degradation using the above test procedure, except for the following characteristics. The glass dishes used in Example 1 had a 27 mm inner diameter instead of the 12.9 mm listed in the procedures. One cc of ferrofluid was pour into the glass dish forming a ferrofluid height of about 1.7 mm. The treated ferrofluid samples were subjected to the conditions specified in Table 1-1 without performing a separate aging procedure or gel test procedure at a higher temperature.

Table 1-1 illustrates the conditions under which each of the four different ferrofluids was subjected. All treated samples having the same base ferrofluid were exposed under the same indicated conditions.

TABLE 1-1

| Ferrofluid | Aging Condition (Temp/Relative Humidity) |
|---|---|
| CSG26 (poly α-olefin) | 90° C./90% RH |
| CSG24A (poly α-olefin) | 80° C./90% RH |
| CSG33 (diester + alkylnapthalene) | 70° C./80% RH |
| CFF100A (diester + trimellitate ester) | 80° C./90% RH |

Table 1-2 illustrates the gel time data for the various ferrofluid samples treated with the different nickle powders and at the different quantity of elemental modifier added to the ferrofluid and exposed to the conditions listed in Table 1-1 above.

TABLE 1-2

| Sample | Wt. % Ni | Gel Time (days) |
|---|---|---|
| CSG26 | 0 | 400–650 |
| CSG26 + P1 | 5 | >2000 |
| | 10 | >2000 |
| CSG26 + P2 | 5 | >2000 |
| | 10 | >2000 |
| CSG24A | 0 | 14–20 |
| CSG24A + $P_1$ | 5 | 550–750 |
| | 10 | 400–700 |
| CSG24A + $P_2$ | 5 | 400–450 |
| | 10 | 650–750 |
| CSG33 | 0 | 8–9 |
| CSG33 + $P_1$ | 5 | 65–390 |
| | 10 | 65–390 |
| CSG33 + $P_2$ | 5 | 65–390 |
| | 10 | 65–390 |
| CFF100A | 0 | 20–54 |
| CFF100A + $P_1$ | 5 | 350–390 |
| | 10 | 350–390 |
| CFF100A + $P_2$ | 5 | 350–390 |
| | 10 | 350–390 |

The data indicates that when nickel is used as an elemental modifier to treat ferrofluids, the elemental modifier extends the time period for each treated ferrofluid before gelation occurs.

EXAMPLE 2

In this example, one nickle powder was tested for its effect on the useful life of eight different ferrofluids. The nickle powder used was the one that was previously labeled as $P_1$. Each sample type was tested for effectiveness when treated with 10 wt. percent of nickle. The eight types of ferrofluids differ from one another either in the material used as the oil-base carrier liquid or in the dispersant used to coat the magnetic particles of the ferrofluid. The oil-based carriers are either polar or nonpolar liquids such as poly α-olefin, a mixture of diester and alkylnaphthalene, trimellitate ester, a mixture of diesters and trimellitate ester, hindered polyol esters, etc. The ferrofluids are available from Ferrotec Corporation, Tokyo, Japan under the catalog numbers CSG26 (poly α-olefin), CSG24A (poly α-olefin), CSG33 (diester+alkylnapthalene), CFF100A (diester+trimellitate ester), CFF200A (trimellitate ester), C103 (trimellitate ester), M200 (hindered polyol ester), and H200 (hindered polyol ester). The ferrofluids were treated using the treatment procedure previously mentioned and then tested for oxidative degradation using the above test procedure. The treated ferrofluid samples were subjected to various aging times and tested using various oxidative degradation temperatures.

Enough samples were created to test the effect of aging based on the aging process lasting 2, 5, 10, 20, and 50 days. Also, the oxidative degradation tests were carried out at two different elevated temperatures, either 150° C. and 130° C. or 170° C. and 150° C., depending on the type of ferrofluid.

Table 2-1 illustrates the aging conditions for each of the eight different ferrofluids

TABLE 2-1

| Ferrofluid (base oil type) | Aging Condition (Temp/Relative Humidity) |
|---|---|
| CSG26 (poly α-olefin) | 90° C./90% RH |
| CSG24A (poly α-olefin) | 80° C./90% RH |
| CSG33 (diester + alkylnapthalene) | 60° C./80% RH |
| CFF100A (diester + trimellitate ester) | 80° C./90% RH |
| CFF200A (trimellitate ester) | 90° C./90% RH |
| C103 (trimellitate ester) | 90° C./90% RH |
| M200 (hindered polyol ester) | 80° C./90% RH |
| H200 (hindered polyol ester) | 80° C./90% RH |

Tables 2-2A and 2-2C illustrate the gel time data for the various ferrofluid sample treated with the nickle powder and aged for 2, 5 and 10 days before running the gel time test. The gel times listed under the "0" days aged represent the gel time of the control sample that was not subjected to the treatment and aging process.

TABLE 2-2A (Gel Time in Hours at Given Temp.)

| | Ferrofluid | | | | | |
|---|---|---|---|---|---|---|
| | CSG26 | | CSG24A | | CSG33 | |
| Days Aged | 150° C. | 130° C. | 150° C. | 130° C. | 150° C. | 130° C. |
| 0 | 69–90 | 180–245 | 0–40 | 180–200 | 68–90 | 200–225 |
| 2 | 69–90 | 245–270 | 40–65 | 250–280 | 68–90 | 200–225 |
| 5 | 105–130 | 310–335 | 40–65 | 300–320 | 68–90 | 200–225 |
| 10 | 105–130 | 380–410 | 65–85 | 410–450 | 68–90 | 175–200 |

TABLE 2-2B (Gel Time in Hours at Given Temp.)

| | Ferrofluid | | | | | |
|---|---|---|---|---|---|---|
| | CFF100A | | CFF200A | | C103 | |
| Days Aged | 150° C. | 130° C. | 170° C. | 150° C. | 170° C. | 150° C. |
| 0 | 160–175 | 600–650 | 290–310 | 1050–1100 | 450–475 | 1800–1950 |
| 2 | 160–175 | 600–630 | 310–325 | 1160–1175 | 450–475 | 1950–2000 |
| 5 | 175–200 | 700–750 | 325–350 | 1220–1375 | 475–495 | 2025–2075 |
| 10 | 230–245 | 800–850 | 380–405 | 1380–1390 | 495–525 | 2075–2100 |

TABLE 2-2C (Gel Time in Hours at Given Temp.)

| Ferrofluid | M200 | | H200 | |
|---|---|---|---|---|
| Days Aged | 150° C. | 130° C. | 150° C. | 130° C. |
| 0 | 225–275 | 1490–1510 | 210–275 | 1500–1550 |
| 2 | 275–295 | 2000–2050 | 275–300 | 2000–2050 |
| 5 | 360–380 | 2700–2750 | 425–450 | 2750–2800 |
| 10 | 540–590 | 3300–3400 | 650–675 | 3300–3400 |

Table 2-2D illustrates the gel time data for the various ferrofluid samples treated with the nickle powder and aged for 20 days before running the gel time test versus the comparative sample using the standard ferrofluid of the type shown.

TABLE 2-2D (Gel Time in Hours at Given Temp.)

| Ferrofluid Type | Comparative Sample | 150° C. | Comparative Sample | 130° C. |
|---|---|---|---|---|
| CSG26 | 41–63 | 63–85 | 205–230 | 320–365 |
| CSG24A | 20–42 | 110–135 | 185–200 | 575–590 |
| CFF100A | 155–175 | 280–320 | 600–630 | 1250–1300 |
| M200 | 220–240 | 675–725 | 1400–1500 | 3200–3400 |
| H200 | 215–230 | 825–835 | 1450–1500 | 3550–3700 |
| | | 170° C. | | 150° C. |
| CFF200A | 270–290 | 400–450 | 900–920 | 1350–1475 |
| C103 | 400–450 | 500–520 | 1750–1850 | 1980–2150 |

Table 2-2E illustrates the gel time data for the various ferrofluid samples treated with the nickle powder and aged for 50 days before running the gel time test versus the comparative sample using the standard ferrofluid of the type shown.

TABLE 2-2E (Gel Time in Hours at Given Temp.)

| Ferrofluid Type | Comparative Sample | 150° C. | Comparative Sample | 130° C. |
|---|---|---|---|---|
| CSG26 | 47–68 | 68–90 | 225–275 | 435–460 |
| CSG24A | 22–44 | 138–185 | 160–185 | 750–800 |
| CFF100A | 135–180 | 340–365 | 750–790 | 1850–2000 |
| M200 | 290–310 | 890–940 | 1520–1600 | 4000–4200 |
| H200 | 300–320 | 1110–1160 | 1550–1600 | 4150–4350 |

TABLE 2-2E-continued (Gel Time in Hours at Given Temp.)

| | 170° C. | | | 150° C. |
|---|---|---|---|---|
| CFF200A | 290–310 | 490–530 | 850–900 | 1800–1900 |
| C103 | 380–400 | 560–600 | 1750–1850 | 2150–2250 |

EXAMPLE 3

Various other elemental powders were tested in the treatment procedure for their effect an the useful life of four different ferrofluids. The ferrofluids are available from Ferrotec Corporation under the catalog numbers H200, CFF200A, REN2050, and 071599YH2. REN 2050 is a poly α-olefin-based ferrofluid and 071599YH2 is a silicone-based ferrofluid. The elemental modifiers tested are available from the Nilaco Corporation, 1-20-6 Ginza Chuo-ku, Tokyo, Japan, and are listed in Table 3-1 along with their average particle size and purity listed by Nilaco Corporation in its literature. Each sample was aged for 20 days at 90° C. and 90% RH (relative humidity) before being subjected to the gel test procedure. The gel test results are given in Table 3-2A to 3-2D.

TABLE 3-1

| Metal | Cat. No. | Particle size | Purity (%) |
|---|---|---|---|
| Al | AL-014250 | 68–165 μm | 99.85 |
| Si | SI-504600 | 68–165 μm | 99.9 |
| Ti | TI-454101 | 45 μm | 99.3 |
| V | V-474100 | <75 μm | 99.5 |
| Cr | CR-094250 | <75 μm | 99 |
| Mn | MN-284101 | 1–5 μm | 99.98 |
| Fe | FE-224500 | 45 μm | 99+ |
| Co | CO-104500 | 27 μm | 99+ |
| Ni | NI-314013 | 3–7 μm | 99.9 |
| Cu | CU-114125 | 100 μm | 99.8 |
| Zn | ZN-484111 | 165 μm | 99.98 |
| Ag | AG-404101 | 45 μm | 99.9 |
| Pt | PT-354010 | 50 μm | 99.98 |
| Au | AU-174021 | 2 μm | 99.5 |

TABLE 3-2A (Gel Time for H200 Ferrofluid at 150° C.)

| Metal | Hours | Metal | Hours |
|---|---|---|---|
| No Metal/No Aging | 246–268 | — | — |
| Al | 287–311 | Ni | 384.5–405.5 |
| Si | 268–287 | Zn | 604.0–672.5 |
| Ti | 268–287 | Ag | 268–287 |
| Cr | 268–287 | Pt | 287–311 |
| Co | 384.5–440.5 | Au | 268–311 |

TABLE 3-2B

| (Gel Time for CFF200A Ferrofluid at 170° C.) | |
|---|---|
| Metal | Hours |
| No Metal/No Aging | 224–246 |
| Co | 384.5–405.5 |
| Ni | 311–354.5 |
| Zn | 311–354.5 |

TABLE 3-2C

| (Gel Time for REN2050 Ferrofluid at 170° C.) | |
|---|---|
| Metal | Hours |
| No Metal/No Aging | 133.5–155.5 |
| Mn | 155.5–178.0 |
| Co | 246–268 |
| Ni | 178–201.5 |
| Zn | 287–311 |

TABLE 3-2D

| (Gel Time for 071599YH2 Ferrofluid at 150° C.) | |
|---|---|
| Metal | Hours |
| No Metal/No Aging | 276.0–297.5 |
| Mn | 298.0–319.5 |
| Fe | 298.0–319.5 |
| Cu | 1240.0–1260.5 |
| Co | 298.0–319.5 |
| Ni | 298.0–319.5 |
| Zn | 298.0–319.5 |

In yet another set of samples, the excess elemental modifiers were separated from the three ferrofluids (H200, CFF200A and REN2050) after aging but before the gel test. These test samples were carried out in glass dishes having a 27 mm inner diameter with about 3 mm thickness. Approximately 0.2 grams (about 10 wt. % to the ferrofluid weight) was added to the dish. After aging, the elemental modifiers were separated from the ferrofluids using a Whatman #1 filter paper. The samples for the gel test were prepared in the previously described glass dishes having a 12.9 mm inner diameter. It was found, as illustrated in Table 3-2E, that some of the elemental modifiers continued to have the effect of improving the life of the three ferrofluids tested even after the fluid had no visually apparent elemental modifier present.

TABLE 3-2E

| Excess Elemental Modifier Removed (Gel Time in Hours) | | | |
|---|---|---|---|
| Modifier | H200 (150° C.) | CFF200A (170° C.) | REN2050 (170° C.) |
| No Modifier | 300–368.5 | 255.0–261.0 | 175.0–214.5 |
| Ni | 683.5–713.5 | 351.5–370.0 | 232.0–255.0 |
| Co | 520.5–544.0 | 439.5–461.5 | 351.5–370.0 |
| Zn | — | 375.0–393.5 | 351.5–370.0 |

In addition to testing the effect of individual elements on the life of the ferrofluid, mixtures of various elements were also tested for their effect on prolonging the effective useful life of ferrofluids. A 50/50 mix of each metal pair was used as the metal additive for the tested ferrofluids. The treated ferrofluids were aged for 20 days at the temperature and relative humidity previously given. Table 3-3 illustrates mixtures for treating the ferrofluid known as CFF200A. Table 3-4 illustrates mixtures for treating the ferrofluid known as REN2050.

TABLE 3-3

| (Gel Time for CFF200A at 170° C.) | | | |
|---|---|---|---|
| Metal Mixture | Hours | Metal Mixture | Hours |
| No metal/ No Aging | 236–252 | — | — |
| Ni + Cu | 274–305 | Zn + Ag | 344–365 |
| Zn + Cu | 305–319 | Ni + Ti | 305–319 |
| Co + Ni | 389–409 | Ni + Al | 274–305 |
| Ni + Zn | 365–389 | Ni + Pt | 305–319 |
| Co + Zn | 389–430 | Ni + Ag | 305–319 |
| Zn + Ti | 344–365 | Alloy Cu + Zn (65:35) | 305–319 |
| Zn + Al | 344–365 | Alloy Cu + Ni (70:30) | 274–305 |
| Zn + Pt | 365–389 | | |

TABLE 3-4

| (Gel Time for REN2050 at 170° C.) | | | |
|---|---|---|---|
| Metal Mixture | Hours | Metal Mixture | Hours |
| No metal/ No Aging | 142–173 | — | — |
| Ni + V | 191–236 | Zn + Ti | 274–305 |
| Ni + Fe | 142–191 | Zn + Al | 274–305 |
| Zn + V | 274–305 | Zn + Pt | 305–319 |
| Zn + Fe | 274–305 | Zn + Ag | 274–305 |
| Zn + Cu | 236–252 | Ni + Ti | 209.75–236 |
| Co + Ni | 274–305 | Ni + Al | 191–236 |
| Ni + Zn | 274–305 | Ni + Pt | 191–236 |
| Co + Zn | 305–319 | Ni + Ag | 209.75–236 |

EXAMPLE 4

Treatment with 50/50 mix of elemental modifier provided considerable improvement to the useful life of the tested ferrofluids. Testing was expanded to include various ratios of the mix of the elemental modifier as well as a comparison between element mixtures and alloys having approximately the same ratio mix. Table 4-1A lists the metal alloys and Table 4-1B lists the metal mixtures used and their corresponding designations, which are used in the remaining tables in this Example 4. The ferrofluids tested are identified by catalog number CSG24A, CFF100A and CSG26, all available from Ferrotec Corporation, Japan. Alloy numbers H and I are available from Soekawa Chemical Co., Ltd., 2-10-12 Kanda Chiyoda-ku, Tokyo, Japan. The nickel powder used in these tables was the catalog No. 200 from Yamaishi Metals Corp. As previously indicated, a majority of the elemental modifiers are available from Nilaco Corporation.

TABLE 4-1A (Alloys)

| Symbol | Name | Supplier | Catalog No. | Particle size | Composition |
|---|---|---|---|---|---|
| A | Bronze | Nilaco | 963441 | — | Cu:Sn 90:10 |
| B | Cupro Nickel | Nilaco | 963311 | 200–300 mesh | Cu:Ni 90:10 |
| C | Nickel Chromium | Nilaco | 694110 | 10 μm | Ni:Cr 80:20 |
| D | Nickel Silver | Nilaco | 714110 | 10 μm | Cu:Zn:Ni 62:20:18 |
| E | Palladium Silver | Nilaco | 704191 | 0.5–2 μm | Pd:Ag 10:90 |
| F | SUS 304 | Nilaco | 754304 | 2–10 μm | Note 1 |
| G | SUS 316L | Nilaco | 784316 | <100 mesh | Note 2 |
| H | Zirconium Nickel | Soekawa | ZR-0127 | — | Zr:Ni 50:50 |
| I | Titanium Nickel | Soekawa | TI-0173 | — | Ti:Ni 50:50 |

Note 1:
Cr:Ni:Mn:Si:Fe = 18–20:8–11:<2:<1:balance
Note 2:
Cr:Ni:Mn:Si:Mo:Fe = 16–18:10–14:<2:<1:2–3:balance

TABLE 4-1B (Metal Mixtures)

| Symbol | Name | Ratio |
|---|---|---|
| J | Cu:Sn | 90:10 |
| K | Cu:Ni | 90:10 |
| L | Cu:Ni | 70:30 |
| M | Ni:Cr | 80:20 |
| N | Cu:Zn:Ni | 62:20:18 |
| O | Pd:Ag | 10:90 |
| P | Note 3 | Note 4 |
| Q | Note 5 | Note 6 |
| R | Cu:Zn | 65:35 |
| S | Cu:Zn | 80:20 |
| T | Zr:Ni | 50:50 |
| U | Ti:Ni | 50:50 |
| V | Ti:Zr | 34.8:65.2 |
| W | Cu:Zn | 100:0 |
| X | Cu:Zn | 50:50 |
| Y | Cu:Zn | 35:65 |
| Z | Cu:Zn | 0:100 |
| AA | Cu:Ni | 50:50 |
| AB | Cu:Ni | 30:70 |
| AC | Cu:Ni | 0:100 |
| AD | Co:Ni | 100:0 |
| AE | Co:Ni | 75:25 |
| AF | Co:Ni | 50:50 |
| AG | Co:Ni | 25:75 |
| AH | Ni:Zn | 75:25 |
| AI | Ni:Zn | 50:50 |
| AJ | Ni:Zn | 25:75 |
| AK | Co:Zn | 75:25 |
| AL | Co:Zn | 50:50 |
| AM | Co:Zn | 25:75 |

Note 3:
Cr:Ni:Mn:Si:Fe
Note 4:
18–20:8–11:<2:<1:Balance
Note 5:
Cr:Ni:Mn:Si:Mo:Fe
Note 6:
16–18:10–14:<2:<1:2–3:Balance The above-listed elemental modifiers were used to treat samples of ferrofluid CSG24A that were aged for twenty (20) days at 80° C./90% RH and 20 days at room temperature and relative humidity as well as some for fifty (50) and eighty (80) days at 80° C./90% RH. Table 4-2 provides the ratio of the gel time for the metal modified ferrofluid aged by the two aging processes to the gel time of the unmodified ferrofluid aged at room temperature and relative humidity. Any ratio greater than one (1.0) indicates an improved ferrofluid. It is noted that both aging procedures improved the useful life of the treated/modified ferrofluid over the untreated/unmodified ferrofluid. However, the aging procedure conducted at the elevated temperature and elevated relative humidity showed a greater improvement.

TABLE 4-2

(CSG24A)

| | 20 days | | 50 days | 80 days |
|---|---|---|---|---|
| Symbol | Room temp. | 80 C./ 90% RH | 80 C./ 90% RH | 80 C./ 90% RH |
| Comparative | 1.0 Note 1 | 1.0 | — | — |
| A | 1.7 | 1.7 | — | — |
| B | 1.7 | 1.7 | — | — |
| C | 1.0 | 1.0 | — | — |
| D | 1.7 | 2.2 | 2.0 | 1.1 |
| E | 1.0 | 1.0 | — | — |
| F | 1.0 | 1.0 | — | — |
| G | 1.0 | 1.0 | — | — |
| H | 1.0 | 1.0 | — | — |
| I | 1.0 | 1.0 | — | — |
| J | 1.7 | 1.7 | — | — |
| K | 1.7 | 1.7 | — | — |
| L | 1.7 | 2.5 | 1.7 | 1.1 |
| M | 1.0 | 2.8 | 3.1 | 2.5 |
| N | 2.2 | 2.8 | 2.0 | 1.1 |
| O | 1.0 | 1.0 | — | — |
| P | 1.0 | Gelled | — | — |
| Q | 1.0 | Gelled | — | — |
| R | 2.2 | 2.8 | 1.7 | Gelled |
| S | 2.2 | 2.2 | 1.7 | Gelled |
| T | 1.0 | 2.8 | 2.9 | 3.1 |
| U | 1.0 | 3.3 | 3.1 | 3.5 |
| V | 1.0 | 1.0 | — | — |
| W | 1.4 | 1.4 | — | — |
| X | 2.9 | 3.7 | 3.2 | 2.0 |
| Y | 2.9 | 3.7 | 3.4 | 2.7 |
| Z | 2.1 | 4.5 | 2.4 | 3.5 |
| AA | 1.7 | 2.7 | 2.4 | 1.5 |

TABLE 4-2-continued

| | (CSG24A) | | | |
|---|---|---|---|---|
| | 20 days | | 50 days | 80 days |
| Symbol | Room temp. | 80 C./ 90% RH | 80 C./ 90% RH | 80 C./ 90% RH |
| AB | 1.7 | 2.9 | 2.4 | 2.0 |
| AC | 1.0 | 2.5 | 3.6 | 3.5 |
| AD | 1.6 | 3.3 | 3.8 | 3.5 |
| AE | 1.4 | 3.3 | Note 2 | 3.6 |
| AF | 1.4 | 3.3 | 4.6 | 4.3 |
| AG | 1.4 | 3.3 | 4.4 | 4.3 |
| AH | 1.7 | 3.8 | 5.2 | 4.7 |
| AI | 2.1 | 4.7 | 5.2 | 4.3 |
| AJ | 2.1 | 4.5 | Note 2 | 2.7 |
| AK | 1.7 | 4.8 | 6.8 | 4.3 |
| AL | 2.4 | 5.2 | 6.0 | 6.4 |
| AM | 2.4 | 4.8 | 5.2 | 5.2 |

Note 1:
the ferrofluid was contacted with element(s) at room temp.
Note 2:
the ferrofluid migrated on the wall of dish and the fluid was lost due to the migration.

The elemental modifiers were used to treat samples of ferrofluid CFF100A that were aged for twenty (20) days at 80° C./90% RH and 20 days at room temperature and relative humidity as well as some for fifty (50) and eighty (80) days at 80° C./90% RH. Like Table 4-2, Table 4-3 provides the ratio of the gel time for the metal modified ferrofluid aged by the two aging processes to the gel time of the unmodified ferrofluid aged at room temperature and relative humidity. Any ratio greater than one (1.0) indicates an improved ferrofluid.

TABLE 4-3

| | (CFF100A) | | | |
|---|---|---|---|---|
| | 20 days | | 50 days | 80 days |
| Symbol | Room temp. | 80 C./ 90% RH | 80 C./ 90% RH | 80 C./ 90% RH |
| Comparative | 1.0 Note 1 | 1.0 | 1.8 | 1.9 |
| A | 1.0 | 1.0 | — | — |
| B | 1.0 | 1.0 | — | — |
| C | 1.0 | 1.0 | — | — |
| D | 1.0 | 1.6 | — | — |
| E | 1.0 | 1.0 | — | — |
| F | 1.0 | 1.0 | — | — |
| G | 1.0 | 1.0 | — | — |
| H | 1.0 | 1.0 | — | — |
| I | 1.0 | 1.0 | — | — |
| J | 1.2 | 1.0 | — | — |
| K | 1.0 | 1.0 | — | — |
| L | 1.0 | 1.6 | — | — |
| M | 1.0 | 2.0 | 2.9 | Note 2 |
| N | 1.2 | 1.6 | — | — |
| O | 1.0 | 1.0 | — | — |
| P | 1.0 | 0.9 | — | — |
| Q | 1.0 | 0.8 | — | — |
| R | 1.4 | 1.9 | — | — |
| S | 1.2 | 1.6 | — | — |
| T | 1.0 | 2.0 | 2.9 | Note 2 |
| U | 1.0 | 2.0 | 2.9 | Note 2 |
| V | 1.0 | 1.0 | — | — |
| W | 1.2 | 1.0 | — | — |
| X | 1.6 | 0.5 | — | — |
| Y | 1.6 | 0.8 | — | — |
| Z | 1.5 | 0.1 | — | — |
| AA | 1.4 | 1.6 | — | — |
| AB | 1.4 | 1.6 | — | — |

TABLE 4-3-continued

| | (CFF100A) | | | |
|---|---|---|---|---|
| | 20 days | | 50 days | 80 days |
| Symbol | Room temp. | 80 C./ 90% RH | 80 C./ 90% RH | 80 C./ 90% RH |
| AC | 1.2 | 1.6 | — | — |
| AD | 1.2 | 2.2 | 1.7 | 1.6 |
| AE | 1.2 | 2.2 | 1.7 | 1.6 |
| AF | 1.2 | 1.8 | — | — |
| AG | 1.2 | 2.7 | 3.0 | Note 2 |
| AH | 1.4 | 1.6 | — | — |
| AI | 1.5 | 0.5 | — | — |
| AJ | 1.5 | 0.1 | — | — |
| AK | 1.4 | 2.6 | 2.7 | Note 2 |
| AL | 1.5 | 0.2 | — | — |
| AM | 1.5 | 0.3 | — | — |

Note 1:
the ferrofluid was contacted with element(s) at room temp.
Note 2:
the ferrofluid migrated on the wall of dish and the fluid was lost due to the migration.

In yet another test, the elemental modifiers were used to treat samples of ferrofluid CSG26 that were aged for twenty (20) days at 80° C./90% RH and 20 days at room temperature and relative humidity as well as some for fifty (50) and eighty (80) days at 80° C./90% RH. Table 4-4 provides the ratio of the gel time for the element modified ferrofluid aged by the two aging processes to the gel time of the unmodified ferrofluid aged at room temperature and relative humidity. Any ratio greater than one (1.0) indicates an improved ferrofluid.

TABLE 4-4

| | (CSG26) | | | |
|---|---|---|---|---|
| | 20 days | | 50 days | 80 days |
| Symbol | Room temp. | 80 C./ 90% RH | 80 C./ 90% RH | 80 C./ 90% RH |
| Comparative | 1.0 Note 1 | 1.1 | 1.2 | 1.3 |
| A | 0.7 | 0.7 | — | — |
| B | 0.7 | 0.8 | — | — |
| C | 1.0 | 1.1 | — | — |
| D | 1.0 | 1.1 | — | — |
| E | 1.0 | 1.2 | — | — |
| F | 1.0 | 1.2 | — | — |
| G | 1.0 | 1.1 | — | — |
| H | 1.0 | 1.2 | — | — |
| I | 1.0 | 1.2 | — | — |
| J | 0.7 | 0.8 | — | — |
| K | 0.7 | 0.8 | — | — |
| L | 0.7 | 0.8 | — | — |
| M | 1.0 | 1.6 | — | — |
| N | 0.7 | 0.8 | — | — |
| O | 1.0 | 1.1 | — | — |
| P | 1.0 | 1.5 | — | — |
| Q | 1.0 | 1.6 | — | — |
| R | 0.7 | 0.9 | — | — |
| S | 0.7 | 0.8 | — | — |
| T | 0.9 | 1.5 | — | — |
| U | 0.9 | 1.6 | — | — |
| V | 1.0 | 1.1 | — | — |
| W | 0.8 | 0.8 | — | — |
| X | 0.8 | 0.8 | — | — |
| Y | 0.8 | 0.8 | — | — |
| Z | 1.3 | 2.9 | 2.8 | 3.2 |
| AA | 0.8 | 1.0 | — | — |
| AB | 0.8 | 1.0 | — | — |
| AC | 1.0 | 1.8 | — | — |

TABLE 4-4-continued

| | (CSG26) | | | |
|---|---|---|---|---|
| | 20 days | | 50 days | 80 days |
| Symbol | Room temp. | 80 C./ 90% RH | 80 C./ 90% RH | 80 C./ 90% RH |
| AD | 1.0 | 2.3 | 1.5 | 1.4 |
| AE | 1.0 | 2.3 | 1.5 | Note 2 |
| AF | 1.0 | 2.4 | 1.6 | 1.9 |
| AG | 1.0 | 2.5 | 2.0 | 2.3 |
| AH | 1.2 | 2.5 | 2.2 | 2.8 |
| AI | 1.2 | 2.7 | 2.6 | 2.9 |
| AJ | 1.3 | 2.8 | 2.8 | 3.1 |
| AK | 1.2 | 2.5 | 1.9 | 2.0 |
| AL | 1.2 | 2.7 | 2.1 | 2.8 |
| AM | 1.3 | 2.8 | 2.7 | 3.1 |

Note 1:
the ferrofluid was contacted with element(s) at room temp.
Note 2:
the ferrofluid migrated on the wall of dish and the fluid was lost due to the migration.

The large combination of mixtures and alloys was also chosen to see if there developed a synergistic effect that provided for a longer useful life of a treated ferrofluid than was provided by treatment with one or the other of the elements in the mixture. It was surprising to learn that certain combinations of elements did provide a synergistic effect. The reasons for such a synergistic effect are not clear, however, a comparison of the gel test data indicates that the combination of certain elements in certain ratios used to treat a ferrofluid does produce a synergistic effect. Table 4-5 illustrates the synergistic effect for a few of the elemental modifier combinations. The numbers represent the ratio of the gel time for the metal modified ferrofluid to the gel time of the unmodified ferrofluid aged at room temperature and relative humidity.

TABLE 4-5A (Synergistic Effects for Co-based Pair; Aged 20 Days)

| Metal | Co—Zn | Metal Mixture Ratio Symbol | | | | |
|---|---|---|---|---|---|---|
| Mixture Sample | Aging Condition | 100-0 AD | 75-25 AK | 50-50 AL | 25-75 AM | 0-100 Z |
| CSG24A | 80° C./90% RH | 3.3 | 4.8 | 5.2 | 4.8 | 4.5 |
| | Room Temp. | 1.6 | 1.7 | 2.4 | 2.4 | 2.1 |
| CFF100A | 80° C./90% RH | 2.2 | 2.6 | 0.2 | 0.3 | 0.1 |
| | Room Temp. | 1.2 | 1.4 | 1.5 | 1.5 | 1.5 |
| CSG26 | 80° C./90% RH | 2.3 | 2.5 | 2.7 | 2.8 | 2.9 |
| | Room Temp. | 1.0 | 1.2 | 1.2 | 1.3 | 1.3 |
| | Co—Ni | AD | AE | AF | AG | AC |
| CSG24A | 80° C./90% RH | 3.3 | 3.3 | 3.3 | 3.3 | 2.52 |
| | Room Temp. | 1.6 | 1.4 | 1.4 | 1.4 | 1 |
| CFF100A | 80° C./90% RH | 2.2 | 2.2 | 1.8 | 2.7 | 1.6 |
| | Room Temp. | 1.2 | 1.2 | 1.2 | 1.2 | 1.2 |
| CSG26 | 80° C./90% RH | 2.3 | 2.3 | 2.4 | 2.5 | 1.8 |
| | Room Temp. | 1.0 | 1.0 | 1.0 | 1.0 | 1.0 |

TABLE 4-5B (Synergistic Effects for Cu-based Pair; Aged 20 Days)

| Metal | Cu—Zn | Metal Mixture Ratio Symbol | | | | | |
|---|---|---|---|---|---|---|---|
| Mixture Sample | Aging Condition | 100-0 W | 80-20 S | 65-35 R | 50-50 X | 35-65 Y | 0-100 Z |

TABLE 4-5B-continued (Synergistic Effects for Cu-based Pair; Aged 20 Days)

| | | | | | | | |
|---|---|---|---|---|---|---|---|
| CSG24A | 80° C./90% RH | 1.4 | 2.2 | 2.8 | 3.7 | 3.7 | 4.5 |
| | Room Temp. | 1.4 | 2.2 | 2.2 | 2.9 | 2.9 | 2.1 |
| CFF100A | 80° C./90% RH | 1.0 | 1.6 | 1.9 | 0.5 | 0.8 | 0.1 |
| | Room Temp. | 1.2 | 1.2 | 1.4 | 1.6 | 1.6 | 1.5 |
| CSG26 | 80° C./90% RH | 0.8 | 0.8 | 0.9 | 0.8 | 0.8 | 2.9 |
| | Room Temp. | 0.8 | 0.7 | 0.7 | 0.8 | 0.8 | 1.3 |
| | Cu—Ni | 90-10 K | 70-30 L | 50-50 AA | 30-70 AB | 0-100 AC | |
| CSG24A | 80° C./90% RH | 1.7 | 2.5 | 2.7 | 2.9 | 2.5 | |
| | Room Temp. | 1.7 | 1.7 | 1.7 | 1.7 | 1.0 | |
| CFF100A | 80° C./90% RH | 1.0 | 1.6 | 1.6 | 1.6 | 1.6 | |
| | Room Temp. | 1.0 | 1.0 | 1.4 | 1.4 | 1.2 | |
| CSG26 | 80° C./90% RH | 0.8 | 0.8 | 1.0 | 1.0 | 1.8 | |
| | Room Temp. | 0.7 | 0.7 | 0.8 | 0.8 | 1.0 | |

TABLE 4-5C (Synergistic Effects for Ni-based Pair; Aged 20 Days)

| Metal Mixture | Ni—Zn Aging | Metal Mixture Ratio | | | | |
|---|---|---|---|---|---|---|
| Sample | Condition | 100-0 | 75-25 | 50-50 | 25-75 | 0-100 |
| CSG24A | 80° C./90% RH | 2.5 | 3.8 | 4.7 | 4.5 | 4.5 |
| | Room Temp. | 1.0 | 1.7 | 2.1 | 2.1 | 2.1 |
| CFF100A | 80° C./90% RH | 1.6 | 1.6 | 0.5 | 0.1 | 0.1 |
| | Room Temp. | 1.2 | 1.4 | 1.5 | 1.5 | 1.5 |
| CSG26 | 80° C./90% RH | 1.8 | 2.5 | 2.7 | 2.8 | 2.9 |
| | Room Temp. | 1.0 | 1.2 | 1.2 | 1.3 | 1.3 |

It is noted that, to date, aging the element-modified ferrofluid at 80° C. and 90% relative humidity appears to enhance the gel time of a ferrofluid. The aging period is dependent on the type of ferrofluid and the selection of elemental modifiers.

EXAMPLE 5

In this example, twenty-eight additional metal and non-metal modifiers were tested using the aging and testing procedures described. Table 5-1 contains the list of metal and nonmetal modifiers, their catalog numbers, manufacturer (The Nilaco Corporation or Soekawa Chemical Co., Ltd.), average particle size, and percent purity. The ferrofluids tested are the same ones tested in Example 4 using aging at 80° C./90% RH except for the control, which was aged at room temperature and room relative humidity.

TABLE 5-1

(Elemental modifiers)

| Symbol | Name | Mfg. | Cat. No. | Particle Size | Purity |
|---|---|---|---|---|---|
| B | Boron | Nilaco | B-054101 | 40 μm | 99 |
| Dy | Dysprosium | Nilaco | DY-124100 | 250–450 μm | 99.9 |
| Er | Erbium | Nilaco | ER-134010 | 250–450 μm | 99.9(0.5% of Ta) |
| Gd | Gadolinium | Nilaco | GD-144010 | <150 μm | 99.9 |
| Ge | Germanium | Nilaco | GE-164010 | <300 μm | 99.999 |
| Ho | Holmium | Soekawa | HO-0001 | <840 μm | 99.9 |
| In | Indium | Nilaco | IN-204010 | <45 μm | 99.999 |
| Ir | Iridium | Nilaco | IR-214010 | ~45–74 μm | 99.9 |
| Pd | Paladium | Nilaco | PD-344000 | 147 μm | 99.9 |
| Pb | Lead | Nilaco | PB-244100 | 74–147 μm | 99.999 |
| Mo | Molybdenum | Nilaco | MO-294100 | 3–5 μm | 99.9+ |
| Nd | Neodymium | Nilaco | ND-304250 | 250–450 μm | 99.9 |
| Nb | Niobium | Nilaco | NB-324111 | <325 mesh (<45 μm) | 99.5 |
| Os | Osmium | Nilaco | OS-334001 | — | 99.9 |
| Re | Rhenium | Nilaco | RE-364010 | 100–200 mesh (approx. 74–147 μm) | 99.99 |
| Rh | Rhodium | Nilaco | RH-374000 | <1 mm | 99.9 |
| Sm | Samarium | Nilaco | SM-394010 | 40 mesh (approx. 350 μm) | 99.9 |
| S | Sulfur | Nilaco | S-804100 | — | 99.99 |
| Ta | Tantalum | Nilaco | TA-414051 | <325 mesh (<45 μm) | 99.9 |
| Sn | Tin | Nilaco | SN-444050 | 150 μm | 99.999 |
| W | Tungsten | Nilaco | W-464101 | 1 μm | 99.95 |
| Y | Yttrium | Nilaco | Y-834100 | 40 mesh (approx. 350 μm) | 99.9 |
| Zr | Zirconium | Nilaco | ZR-494110 | — | — |
| Yb | Ytterbium | Soekawa | YB-0001 | −20 mesh (<840 μm) | 99.9 |
| C | Carbon | Soekawa | C-0001 | 5 μm | 99 |
| Tm | Thulium | Soekawa | TM-0001 | −20 mesh (<840 μm) | 99.9 |
| Tb | Terbium | Soekawa | TB-0001 | −20 mesh (<840 μm) | 99.9 |
| Pr | Praseodymium | Soekawa | PR-0001 | −20 mesh (<840 μm) | 99.9 |

The twenty-eight elemental modifiers were used to treat sufficient samples of ferrofluid CSG24A to conduct aging for 20, 50 and 80 days before subjecting the samples to the gel test. The samples were divided into two groups, one group was aged at 80° C./90% RH and a second group was aged at room temperature and relative humidity. Table 5-2A illustrates the test data for both the treated ferrofluid aged at the elevated temperature and relative humidity and the test data for the treated ferrofluid aged at room temperature and humidity.

TABLE 5-2A (CSG24A: Gel Time in Hours at 150° C.)

| | Condition | | | | | |
|---|---|---|---|---|---|---|
| | 80 C. and 90% RH | | | Room temp. and humidity | | |
| | Duration | | | | | |
| | 20 days | 50 days | 80 days | 20 days | 50 days | 80 days |
| CSG 24A | 24.0–46.5 | 0–22.0 | Note 1 | 24.0–46.5 | 14.0–36.0 | 0–45.0 |
| +B | 24.0–46.5 | 0–22.0 | Note 1 | 24.0–46.5 | 14.0–36.0 | 0–45.0 |
| +Dy | 46.5–66.0 | 48.0–75.0 | 39.0–45.0 | 24.0–46.5 | 14.0–36.0 | 0–45.0 |
| +Er | 46.5–90.5 | 75.0–99.0 | 45.0–58.5 | 24.0–46.5 | 14.0–36.0 | 0–45.0 |
| +Gd | 66.0–90.5 | 48.0–75.0 | 0–19.5 | 24.0–46.5 | 14.0–36.0 | 0–45.0 |
| +Ge | 24.0–46.5 | 0–22.0 | Note 1 | 24.0–46.5 | 14.0–36.0 | 0–45.0 |
| +In | 0–24.0 | Note 1 | Note 1 | 24.0–46.5 | 36.0–51.0 | 0–45.0 |
| +Ir | 24.0–46.5 | 0–22.0 | Note 1 | 24.0–46.5 | 14.0–36.0 | 0–45.0 |
| +Pd | 24.0–46.5 | Note 1 | Note 1 | 24.0–46.5 | 14.0–36.0 | 0–45.0 |

TABLE 5-2A-continued (CSG24A: Gel Time in Hours at 150° C.)

| | Condition | | | | | |
|---|---|---|---|---|---|---|
| | 80 C. and 90% RH | | | Room temp. and humidity | | |
| | Duration | | | | | |
| | 20 days | 50 days | 80 days | 20 days | 50 days | 80 days |
| +Pb | 0–24.0 | Note 1 | Note 1 | 24.0–46.5 | 14.0–36.0 | 0–45.0 |
| +Mo | 18.5–41.0 | 0–15.0 | Note 1 | 18.5–41.0 | 22.5–45.5 | 0–24.0 |
| +Nd | 18.5–41.0 | 15.0–22.5 | 0–24.0 | 18.5–41.0 | 22.5–45.5 | 24.0–48.5 |
| +Nb | 18.5–41.0 | 0–15.0 | Note 1 | 18.5–41.0 | 22.5–45.5 | 24.0–48.5 |
| +Os | 18.5–41.0 | 0–15.0 | Note 1 | 18.5–41.0 | 22.5–45.5 | 24.0–48.5 |
| +Re | 18.5–41.0 | 0–15.0 | Note 1 | 18.5–41.0 | 22.5–45.5 | 24.0–48.5 |
| +Rh | 18.5–41.0 | 15.0–22.5 | Note 1 | 18.5–41.0 | 22.5–45.5 | 24.0–48.5 |
| +Sm | 41.0–59.5 | 0–15.0 | Note 1 | 18.5–41.0 | 22.5–45.5 | 24.0–48.5 |
| +S | 0–18.5 | Note 1 | Note 1 | 0–18.5 | 0–15.0 | 0–24.0 |
| +Ta | 18.5–41.0 | 0–15.0 | Note 1 | 18.5–41.0 | 22.5–45.5 | 0–24.0 |
| +Sn | 18.5–41.0 | Note 1 | Note 1 | 18.5–41.0 | 22.5–45.5 | 24.0–48.5 |
| +W | 18.5–41.0 | Note 1 | Note 1 | 18.5–41.0 | 22.5–45.5 | 24.0–48.5 |
| +Y | 59.5–83.0 | 45.5–67.5 | 24.0–72.0 | 18.5–41.0 | 22.5–45.5 | 24.0–48.5 |
| +Zr | 18.5–41.0 | 0–15.0 | Note 1 | 18.5–41.0 | 22.5–45.5 | 0–48.5 |
| +C | 25.5–51.5 | 23.0–47.0 | Note 1 | 25.5–51.5 | 23.0–47.0 | 22.5–47.0 |
| +Yb | 51.5–76.0 | 47.0–86.5 | 47.0–70.5 | 25.5–51.5 | 23.0–47.0 | 22.5–47.0 |
| +Tm | 51.5–76.0 | 71.5–86.5 | 70.5–93.5 | 25.5–51.5 | 23.0–47.0 | 22.5–47.0 |
| +Ho | 51.5–76.0 | 86.5–94.0 | 70.5–93.5 | 25.5–51.5 | 23.0–47.0 | 22.5–47.0 |
| +Pr | 25.5–51.5 | 47.0–71.5 | 47.0–70.5 | 25.5–51.5 | 23.0–47.0 | 22.5–47.0 |
| +Tb | 76.0–98.5 | 94.0–108.5 | 70.5–93.5 | 25.5–51.5 | 23.0–47.0 | 22.5–47.0 |

Note 1)
The sample got gelled during the aging.

The gel time of the sample at room temperature for 20 days was regarded as the standard, i.e. 1.0. the samples having more than about 10% longer gel time were determined and are illustrated in Table 5-2B.

TABLE 5-2B

Elemental Modifiers Showing 10% Improvement

| | | Duration | | |
|---|---|---|---|---|
| | | 20 days | 50 days | 80 days |
| Room temp. High temp. humidity | CSG 24A | 1.0 | — | — |
| | +In | — | 1.2 | — |
| | +Dy | 1.6 | 1.7 | — |
| | +Er | 1.9 | 2.5 | 1.5 |
| | +Gd | 2.2 | 1.7 | — |
| | +Y | 2.0 | 1.6 | — |
| | +Yb | 1.8 | 1.9 | 1.7 |
| | +Tm | 1.8 | 2.2 | 2.3 |
| | +Ho | 1.8 | 2.6 | 2.3 |
| | +Pr | — | 1.7 | 1.7 |

TABLE 5-2B-continued

Elemental Modifiers Showing 10% Improvement

| | Duration | | |
|---|---|---|---|
| | 20 days | 50 days | 80 days |
| +Tb | 2.5 | 2.8 | 2.3 |
| +Sm | 1.4 | — | — |

The same elemental modifiers were used to treat sufficient samples of ferrofluid CFF100A to conduct aging for 20, 50 and 80 days before subjecting the samples to the gel test. The samples were divided into two groups, one group was aged at 80° C./90% RH and a second group was aged at room temperature and relative humidity. Table 5-3 illustrates the test data for both treated ferrofluid aged at the elevated temperature and relative humidity and for the treated ferrofluid aged at room termperature and humidity.

TABLE 5-3A (CFF100A: Gel Time in Hours at 150° C.)

| | Condition | | | | | |
|---|---|---|---|---|---|---|
| | 80 C. and 90% RH | | | Room temp. and humidity | | |
| | Duration | | | | | |
| | 20 days | 50 days | 80 days | 20 days | 50 days | 80 days |
| CFF 100A | 130.5–155.5 | 186.5–196.0 | 158.5–166.0 | 130.5–155.0 | 136.5–143.0 | 103.0–116.5 |
| +B | 106.5–130.5 | 99.0–123.0 | 0–19.5 | 130.5–155.0 | 113.0–136.5 | 116.5–125.0 |
| +Dy | 130.5–155.0 | 196.0–244.0 | 39.0–45.0 | 130.5–155.0 | 113.0–136.5 | 103.0–116.5 |
| +Er | 130.5–155.0 | 186.5–196.0 | 80.0–87.0 | 130.5–155.0 | 113.0–136.5 | 103.0–116.5 |
| +Gd | 130.5–155.0 | 268.0–287.0 | 138.5–158.5 | 130.5–155.0 | 113.0–136.5 | 103.0–116.5 |

TABLE 5-3A-continued (CFF100A: Gel Time in Hours at 150° C.)

| | Condition | | | | | |
|---|---|---|---|---|---|---|
| | 80 C. and 90% RH | | | Room temp. and humidity | | |
| | Duration | | | | | |
| | 20 days | 50 days | 80 days | 20 days | 50 days | 80 days |
| +Ge | 106.5–130.5 | 48.0–75.0 | Note 1 | 130.5–155.0 | 82.5–113.0 | 103.0–116.5 |
| +In | 90.5–155.5 | 168.0–196.0 | 138.5–231.5 | 130.5–155.0 | 136.5–143.0 | 103.0–116.5 |
| +Ir | 130.5–155.0 | 186.5–196.0 | 158.5–166.0 | 130.5–155.0 | 113.0–143.0 | 116.5–125.0 |
| +Pd | 106.5–155.0 | 148.0–168.0 | 103.0–116.5 | 130.5–155.0 do. | 113.0–136.5 | 103.0–116.5 |
| +Pb | 130.5–155.0 | Note 1 | Note 1 | 130.5–155.0 | 113.0–136.5 | 103.0–116.5 |
| +Mo | 18.5–41.0 | Note 1 | Note 1 | 105.0–133.0 | 118.0–144.5 | 117.5–141.0 |
| +Nd | 105.0–133.0 | 118.0–144.5 | 117.5–191.5 | 105.0–133.0 | 96.0–118.0 | 72.0–95.0 |
| +Nb | 133.0–154.0 | 174.5–188.0 | 117.5–214.5 | 133.0–154.0 | 118.0–144.5 | 117.5–141.0 |
| +Os | 133.0–154.0 | 152.0–166.5 | 48.5–117.5 | 133.0–154.0 | 118.0–144.5 | 117.5–141.0 |
| +Re | 0–59.5 | Note 1 | Note 1 | 105.0–133.0 | 96.0–118.0 | 117.5–141.0 |
| +Rh | 133.0–154.0 | 174.5–188.0 | 191.5–214.5 | 133.0–154.0 | 118.0–144.5 | 117.5–141.0 |
| +Sm | 154.0–180.0 | 166.5–174.5 | 117.5–256.0 | 105.0–133.0 | 96.0–118.0 | 117.5–141.0 |
| +S | 18.5–41.0 | Note 1 | Note 1 | 0–18.5 | 0–15.0 | 0–24.0 |
| +Ta | 133.0–154.0 | 174.5–188.0 | 214.5–232.5 | 105.0–154.0 | 96.0–144.5 | 95.0–141.0 |
| +Sn | 83.0–105.0 | 0–15.0 | Note 1 | 133.0–154.0 | 118.0–144.5 | 117.5–141.0 |
| +W | 18.5–41.0 | 0–15.0 | Note 1 | 133.0–154.0 | 118.0–152.0 | 141.0–165.0 |
| +Y | 154.0–180.0 | 75.0–96.0 | 0–72.0 | 133.0–154.0 | 118.0–144.5 | 117.5–141.0 |
| +Zr | 133.0–154.0 | 152.0–166.5 | 24.0–191.5 | 133.0–154.0 | 118.0–144.5 | 117.5–141.0 |
| +C | 122.5–144.5 | 210.0–218.0 | 190.0–213.0 | 122.5–144.5 | 189.0–202.5 | 116.0–139.5 |
| +Yb | 122.5–144.5 | 210.0–241.5 | 163.5–190.0 | 122.5–144.5 | 202.5–210.0 | 116.0–139.5 |
| +Tm | 144.5–171.0 | 241.5–269.5 | 213.0–231.0 | 122.5–144.5 | 202.5–210.0 | 116.0–139.5 |
| +Ho | 144.5–171.0 | 269.5–292.5 | 231.0–254.5 | 122.5–144.5 | 202.5–210.0 | 116.0–139.5 |
| +Pr | 122.5–144.5 | 210.0–218.0 | 163.5–213.0 | 98.5–122.5 | 181.0–189.0 | 93.5–116.0 |
| +Tb | 171.0–194.0 | 269.5–292.5 | 231.0–275.5 | 122.5–144.5 | 202.5–210.0 | 116.0–139.5 |

Note 1)
The sample got gelled during the aging.

As noted above, the gel time of the sample at room temperature for 20 days was regarded as the standard, i.e. 1.0, the samples having more than about 10% longer gel time were determined and are illustrated in Table 5-3B.

TABLE 5-3B

Elemental Modifiers Showing 10% Improvement

| | | Duration | | |
|---|---|---|---|---|
| | | 20 days | 50 days | 80 days |
| Room temp. | CFF 100A | 1.0 | — | — |
| | +C | — | 1.4 | — |
| | +Yb | — | 1.4 | — |
| | +Tm | — | 1.4 | — |
| | +Ho | — | 1.4 | — |
| | +Pr | — | 1.3 | — |
| | +Tb | — | 1.4 | — |
| High temp. and humidity | CFF 100A | — | 1.3 | 1.1 |
| | +Dy | — | 1.5 | — |
| | +Er | — | 1.3 | — |
| | +Gd | — | 1.9 | — |
| | +In | — | 1.3 | 1.3 |
| | +Ir | — | 1.3 | 1.1 |
| | +Pd | — | 1.1 | — |
| | +Nb | — | 1.3 | 1.2 |
| | +Os | — | 1.1 | — |
| | +Rh | — | 1.3 | 1.4 |
| | +Sm | 1.2 | 1.2 | 1.3 |
| | +Ta | — | 1.3 | 1.6 |
| | +Y | 1.2 | — | — |
| | +Zr | — | 1.1 | — |
| | +C | — | 1.5 | 1.4 |
| | +Yb | — | 1.6 | 1.2 |
| | +Tm | — | 1.8 | 1.6 |
| | +Ho | — | 2.0 | 1.7 |

TABLE 5-3B-continued

Elemental Modifiers Showing 10% Improvement

| | Duration | | |
|---|---|---|---|
| | 20 days | 50 days | 80 days |
| +Pr | — | 1.5 | 1.3 |
| +Tb | 1.3 | 2.0 | 1.8 |

The same elemental modifiers were used to treat sufficient samples of ferrofluid CSG26 to conduct aging for 20, 50 and 80 days before subjecting the samples to the gel test. The samples were divided into two groups, one group was aged at 80° C./90% RH and a second group was aged at room temperature and relative humidity. Table 5-4A illustrates the test data for treated ferrofluid aged at the elevated temperature and relative humidity and the test data for the treated ferrofluid aged at room temperature and humidity to the untreated ferrofluid.

TABLE 5-4A (CSG26: Gel Time in Hours at 150° C.)

| | Condition | | | | | |
|---|---|---|---|---|---|---|
| | 80 C. and 90% RH | | | Room temp. and humidity | | |
| | Duration | | | | | |
| | 20 days | 50 days | 80 days | 20 days | 50 days | 80 days |
| CSG26 | 301.0–309.5 | 268.0–287.0 | 239.0–268.0 | 252.5–280.0 | 214.5–238.0 | 186.0–212.0 |
| +B | 294.5–309.5 | 268.0–287.0 | 239.0–268.0 | 280.0–294.5 | 214.5–238.0 | 186.0–231.5 |
| +Dy | 394.0–408.5 | 427.0–449.0 | 349.5–379.5 | 280.0–294.5 | 214.5–238.0 | 186.0–212.0 |
| +Er | 394.0–408.5 | 427.0–449.0 | 349.5–379.5 | 252.5–294.5 | 214.5–238.0 | 186.0–231.5 |
| +Gd | 372.0–386.0 | 311.5–403.0 | 306.0–314.5 | 252.5–280.0 | 214.5–238.0 | 212.0–231.5 |
| +Ge | 317.5–348.0 | 287.0–403.0 | 253.0–268.0 | 252.5–280.0 | 214.5–238.0 | 212.0–231.5 |
| +In | 372.0–386.0 | 311.5–403.0 | 283.0–298.0 | 301.0–309.5 | 214.5–238.0 | 186.0–231.5 |
| +Ir | 317.5–331.0 | 268.0–311.5 | 239.0–253.0 | 252.5–294.5 | 214.5–238.0 | 186.0–231.5 |
| +Pd | 301.0–309.5 | 311.5–403.0 | 212.0–239.0 | 280.0–294.5 | 214.5–266.0 | 212.0–231.5 |
| +Pb | 752.5–777.5 | 770.0–865.0 | 820.5–845.0 | 451.0–490.5 | 334.5–448.5 | 296.5–318.5 |
| +Mo | 273.0–300.0 | 293.0–319.5 | 165.0–191.5 | 300.0–323.0 | 270.0–293.0 | 231.0–277.0 |
| +Nd | 387.0–395.0 | 459.5–482.5 | 420.0–468.0 | 251.0–273.0 | 270.0–293.0 | 256.0–277.0 |
| +Nb | 273.0–323.0 | 366.0–413.0 | 325.0–349.0 | 251.0–273.0 | 244.5–293.0 | 231.0–277.0 |
| +Os | 300.0–323.0 | 389.5–413.0 | 301.0–373.0 | 251.0–273.0 | 270.0–293.0 | 256.0–277.0 |
| +Re | 251.0–273.0 | 219.5–244.5 | 165.0–214.5 | 251.0–273.0 | 244.5–270.0 | 231.0–256.0 |
| +Rh | 300.0–323.0 | 366.0–389.5 | 301.0–325.0 | 300.0–323.0 | 270.0–293.0 | 256.0–277.0 |
| +Sm | 387.0–395.0 | 482.5–505.0 | 444.0–468.0 | 300.0–323.0 | 270.0–293.0 | 256.0–277.0 |
| +S | 41.0–59.5 | 219.5–270.0 | 141.0–214.5 | 41.0–59.5 | 22.5–45.5 | 24.0–48.5 |
| +Ta | 300.0–323.0 | 366.0–389.5 | 301.0–325.0 | 251.0–323.0 | 195.5–270.0 | 256.0–277.0 |
| +Sn | 273.0–300.0 | 366.0–389.5 | 301.0–325.0 | 300.0–323.0 | 244.5–270.0 | 256.0–277.0 |
| +W | 205.0–227.0 | 293.0–353.5 | 256.0–301.0 | 300.0–323.0 | 270.0–293.0 | 256.0–277.0 |
| +Y | 492.0–523.0 | 579.5–625.0 | 547.0–589.5 | 300.0–323.0 | 270.0–293.0 | 256.0–277.0 |
| +Zr | 273.0–300.0 | 319.5–366.0 | 301.0–325.0 | 300.0–323.0 | 270.0–293.0 | 256.0–301.0 |
| +C | 331.5–353.0 | 413.0–437.5 | 323.5–371.5 | 258.5–282.0 | 343.5–366.0 | 231.0–254.5 |
| +Yb | 406.5–430.0 | 553.0–579.5 | 323.5–466.5 | 282.0–301.5 | 269.5–366.0 | 254.5–275.5 |
| +Tm | 438.0–451.5 | 579.5–625.0 | 347.5–371.5 | 258.5–282.0 | 343.5–366.0 | 254.5–275.5 |
| +Ho | 430.0–451.5 | 579.5–625.0 | 394.5–466.5 | 258.5–282.0 | 343.5–366.0 | 254.5–275.5 |
| +Pr | 353.0–375.5 | 482.5–505.0 | 323.5–347.5 | 258.5–282.0 | 343.5–366.0 | 231.0–254.5 |
| | | | Note 2 | | | |
| +Tb | 375.5–451.5 | 625.0–648.5 | 163.5–190.0 | 258.5–282.0 | 343.5–366.0 | 231.0–275.5 |

Note 2)
The ferrofluid migrated to the wall of glass dish and the amount of ferrofluid decreased a lot. This might be a cause of short gel time.

As noted above, the gel time of the sample at room temperature for 20 days was regarded as the standard, i.e. 1.0, the samples having more than about 10% longer gel time were determined and are illustrated in Table 5-4B.

TABLE 5-4B

Elemental Modifiers Showing 10% Improvement

| | | Duration | | |
|---|---|---|---|---|
| | | 20 days | 50 days | 80 days |
| Room temp. | CSG 26 | 1.0 | — | — |
| | +In | 1.2 | — | — |
| | +Pb | 1.8 | 1.5 | 1.2 |
| | +Mo | 1.2 | — | — |
| | +Rh | 1.2 | — | — |
| | +Sm | 1.2 | — | — |
| | +Sn | 1.2 | — | — |
| | +W | 1.2 | — | — |
| | +Y | 1.2 | — | — |
| | +Zr | 1.2 | — | — |
| | +C | — | 1.3 | — |
| | +Yb | 1.1 | 1.2 | — |
| | +Tm | — | 1.3 | — |
| | +Ho | — | 1.3 | — |
| | +Pr | — | 1.3 | — |
| | +Tb | — | 1.3 | — |
| High temp. and humidity | CSG 26 | 1.2 | — | — |
| | +B | 1.1 | — | — |
| | +Dy | 1.5 | 1.7 | 1.4 |
| | +Er | 1.5 | 1.7 | 1.4 |

TABLE 5-4B-continued

Elemental Modifiers Showing 10% Improvement

| | Duration | | |
|---|---|---|---|
| | 20 days | 50 days | 80 days |
| +Gd | 1.4 | 1.3 | 1.2 |
| +Ge | 1.3 | 1.3 | — |
| +In | 1.4 | 1.3 | — |
| +Ir | 1.2 | — | — |
| +Pd | 1.2 | 1.3 | — |
| +Pb | 2.9 | 3.1 | 3.1 |
| +Mo | — | 1.2 | — |
| +Nd | 1.5 | 1.8 | 1.7 |
| +Nb | 1.1 | 1.5 | 1.3 |
| +Os | 1.2 | 1.5 | 1.3 |
| +Rh | 1.2 | 1.4 | 1.2 |
| +Sm | 1.5 | 1.9 | 1.7 |
| +Ta | 1.2 | 1.4 | 1.2 |
| +Sn | — | 1.4 | 1.2 |
| +W | — | 1.2 | — |
| +Y | 1.9 | 2.3 | 2.1 |
| +Zr | — | 1.3 | 1.2 |
| +C | 1.3 | 1.6 | 1.3 |
| +Yb | 1.6 | 2.1 | 1.5 |
| +Tm | 1.7 | 2.3 | 1.4 |
| +Ho | 1.7 | 2.3 | 1.6 |
| +Pr | 1.4 | 1.9 | 1.3 |
| +Tb | 1.6 | 2.4 | — |

Table 6 summarizes the effective elements and conditions that improved ferrofluid gel time compared to the gel time of the ferrofluid at room temperature and humidity for 20 days as the control or comparative sample.

TABLE 6

Summary of Effective Elemental Modifiers

| Ferrofluid | Condition | Element | Remark |
|---|---|---|---|
| CSG 24A | Room temp. and humidity | In | — |
| | 80 C. and 90% RH | Dy, Er, Gd, Y, Yb, Tm, Ho, Pr, Tb, Sm | — |
| CFF 100A | Room temp. and humidity | C, Yb, Tm, Ho, Pr, Tb | — |
| | 80 C. and 90% RH | Dy, (Er), Gd, (In), (Ir), (Pd), (Nb), (Os), Rh, (Sm), Ta, (Y), (Zr), C, Yb, Tm, Ho, Pr, Tb | Note 1 |
| CSG 26 | Room temp. and humidity | In, Pb, Mo, Rh, Sm, Sn, W, Y, Zr, C, Yb, Tm, Ho, Pr, Tb | — |
| | 80 C. and 90% RH | (B), Dy, Er, Gd, Ge, In, (Ir), Pd, Pb, (Mo), Nd, Nb, Os, Rh, Sm, Ta, Sn, (W), Y, Zr, C, Yb, Tm, Ho, Pr, Tb | Note 1 |

TABLE 6-continued

Summary of Effective Elemental Modifiers

| Ferrofluid | Condition | Element | Remark |
|---|---|---|---|

Note 1:
The ferrofluid exposed to 80 C. and 90% RH without treatment with any element also improved the gel time to the ferrofluid. 1.3 times and 1.2 times improvement were recognized for CFF 100A and CSG 26. Therefore, the effectiveness of the elements in parentheses on the life of the respective ferrofluids is questionable, assuming such improvement should be more than the improvement without treatment.

The same elemental modifiers were used to treat sufficient samples of a ferrofluid that uses a ferrite other than iron oxide as the magnetic particle. A ferrofluid having Manganese-Zinc (Mn—Zn) ferrite particles was obtained from Sigma Hi-Chemical, Inc., 5244-1 Ohba, Fujisawa-shi, Kanagawa-ken, 251-0861 Japan (cat. No. A-300). Sufficient samples of ferrofluid A-300 were used to conduct aging for 20, 50 and 80 days before subjecting the samples to the gel test. The samples were divided into two groups, one group was aged at 80° C./90% RH and a second group was aged at room temperature and relative humidity. Table 7A illustrates the test data for treated ferrofluid aged at the elevated temperature and relative humidity and the test data for the treated ferrofluid aged at room temperature and humidity to the untreated ferrofluid.

TABLE 7A (A-300: Gel Time in Hours at 150° C.)

| | Condition | | | | | |
|---|---|---|---|---|---|---|
| | 80 C. and 90% RH | | | Room temp. and humidity | | |
| | Duration | | | | | |
| | 20 days | 50 days | 80 days | 20 days | 50 days | 80 days |
| A-300 | 100.5–116.0 | 93.5–116.5 | 92.5–116.5 | 100.5–116.0 | 93.5–116.5 | 92.5–116.5 |
| +Gd | 71.5–116.0 | 67.0–93.5 | 69.0–92.5 | 100.5–116.0 | 93.5–134.5 | 92.5–116.5 |
| +Dy | 100.5–116.0 | 93.5–116.5 | 92.5–116.5 | 100.5–116.0 | 93.5–116.5 | 92.5–116.5 |
| +Er | 100.5–116.0 | 93.5–116.5 | 69.0–116.5 | 100.5–116.0 | 93.5–116.5 | 92.5–116.5 |
| +Pb | 100.5–116.0 | 67.0–93.5 | 48.5–69.0 | 128.0–135.5 | 116.5–134.5 | 116.5–132.5 |
| +Ir | 100.5–116.0 | 93.5–116.5 | 92.5–116.5 | 100.5–116.0 | 93.5–116.5 | 92.5–116.5 |
| +In | 100.5–116.0 | 93.5–116.5 | 92.5–116.5 | 100.5–116.0 | 93.5–116.5 | 92.5–116.5 |
| +B | 116.0–121.0 | 93.5–116.5 | 92.5–116.5 | 116.0–121.0 | 116.5–134.5 | 92.5–116.5 |
| +Ge | 116.0–128.0 | 116.5–134.5 | 116.5–132.5 | 116.0–121.0 | 116.5–134.5 | 92.5–116.5 |
| +Ni | 100.5–116.0 | 93.5–116.5 | 92.5–116.5 | 116.0–121.0 | 93.5–134.5 | 92.5–116.5 |
| +Zn | 100.5–116.0 | 93.5–116.5 | 69.0–116.5 | 100.5–116.0 | 93.5–116.5 | 92.5–116.5 |
| +Co | 121.0–128.0 | 116.5–158.0 | 132.5–148.5 | 116.0–121.0 | 116.5–134.5 | 92.5–116.5 |
| +Fe | 100.5–116.0 | 93.5–116.5 | 92.5–116.5 | 100.5–116.0 | 116.5–134.5 | 92.5–116.5 |
| +Cu | 71.5–116.0 | 67.0–93.5 | 48.5–69.0 | 100.5–116.0 | 93.5–116.5 | 92.5–116.5 |
| +V | 22.5–100.5 | 43.0–116.5 | 22.0–69.0 | 116.0–121.0 | 93.5–116.5 | 92.5–116.5 |
| +Mo | 116.0–121.0 | 93.5–116.5 | 92.5–116.5 | 100.5–116.0 | 93.5–116.5 | 92.5–116.5 |
| +Nd | 22.5–71.5 | 0–43.0 | 22.0–48.5 | 100.5–116.0 | 93.5–116.5 | 92.5–116.5 |
| +Nb | 100.5–116.0 | 93.5–116.5 | 92.5–116.5 | 116.0–121.0 | 93.5–116.5 | 92.5–116.5 |
| +Os | 100.5–116.0 | 93.5–116.5 | 92.5–116.5 | 100.5–116.0 | 93.5–116.5 | 92.5–116.5 |
| +Re | 128.0–135.5 | 116.5–158.0 | 116.5–132.5 | 128.0–135.5 | 116.5–134.5 | 116.5–132.5 |
| +Rh | 100.5–116.0 | 93.5–116.5 | 92.5–116.5 | 100.5–116.0 | 93.5–116.5 | 92.5–116.5 |
| +Sm | 159.0–181.5 | 43.0–67.0 | 48.5–69.0 | 100.5–116.0 | 93.5–116.5 | 92.5–116.5 |
| +S | 0–22.5 | 93.5–116.5 | 92.5–116.5 | 0–22.5 | 0–43.0 | 0–22.0 |
| +Ta | 100.5–116.0 | 93.5–116.5 | 92.5–116.5 | 100.5–116.0 | 93.5–116.5 | 92.5–116.5 |
| +Sn | 100.5–116.0 | 93.5–116.5 | 92.5–116.5 | 100.5–116.0 | 93.5–116.5 | 92.5–116.5 |
| +W | 116.0–121.0 | 93.5–116.5 | 92.5–116.5 | 116.0–121.0 | 93.5–116.5 | 92.5–116.5 |
| +Y | 100.5–116.0 | 93.5–116.5 | 69.0–92.5 | 100.5–116.0 | 93.5–116.5 | 92.5–116.5 |
| +Zr | 100.5–116.0 | 93.5–116.5 | 92.5–116.5 | 100.5–116.0 | 93.5–116.5 | 92.5–116.5 |
| +Si | 100.5–116.0 | 93.5–116.5 | 92.5–116.5 | 100.5–116.0 | 93.5–116.5 | 92.5–116.5 |
| +Yb | 100.5–116.0 | 93.5–116.5 | 92.5–116.5 | 100.5–116.0 | 93.5–116.5 | 92.5–116.5 |
| +C | 100.5–116.0 | 93.5–116.5 | 92.5–116.5 | 100.5–116.0 | 93.5–116.5 | 92.5–116.5 |
| +Tm | 100.5–116.0 | 93.5–116.5 | 92.5–116.5 | 100.5–116.0 | 93.5–116.5 | 92.5–116.5 |
| +Tb | 100.5–116.0 | 93.5–116.5 | 92.5–116.5 | 100.5–116.0 | 93.5–116.5 | 92.5–116.5 |
| +Pr | 159.0–181.5 | 93.5–116.5 | 69.0–116.5 | 100.5–116.0 | 93.5–116.5 | 92.5–116.5 |
| +Ho | 100.5–116.0 | 93.5–116.5 | 92.5–116.5 | 100.5–116.0 | 93.5–116.5 | 92.5–116.5 |

As noted above, the gel time of the sample at room temperature for 20 days was regarded as the standard, i.e. 1.0, the samples having more than about 10% longer gel time were determined and are illustrated in Table 7B.

TABLE 7B

Elemental Modifiers Showing 10% Improvement

| | | Duration | | |
|---|---|---|---|---|
| | | 20 days | 50 days | 80 days |
| Room temp. | A-300 | 1.0 | 1.0 | 1.0 |
| | +Gd | — | 1.1 | — |
| | +Pb | 1.2 | 1.2 | 1.2 |
| | +B | 1.1 | 1.2 | — |
| | +Ge | 1.1 | 1.2 | — |
| | +Ni | 1.1 | 1.1 | — |
| | +Co | 1.1 | 1.1 | — |
| | +Fe | — | 1.2 | — |
| | +V | 1.1 | — | — |
| | +Nb | 1.1 | — | — |
| | +Re | 1.2 | 1.2 | 1.2 |
| | +W | 1.1 | — | — |
| High temp. and humidity | A-300 | 1.0 | 1.0 | 1.0 |
| | +B | 1.1 | — | — |
| | +Ge | 1.1 | 1.2 | 1.2 |
| | +Co | 1.2 | 1.3 | 1.3 |
| | +Mo | 1.1 | — | — |
| | +Re | 1.2 | 1.3 | 1.2 |
| | +Sm | 1.6 | — | — |
| | +W | 1.1 | — | — |
| | +Pr | 1.6 | — | — |

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A magnetic fluid composition comprising:

an oil-based, low vapor pressure carrier liquid;

a plurality of magnetic particles coated with at least one surfactant, said plurality of magnetic particles dispersed within said carrier liquid forming a ferrofluid; and at least one elemental modifier disposed without dispersant within said ferrofluid, said at least one elemental modifier being present in said ferrofluid in an amount greater than zero percent and equal to or less than ten percent by weight to the weight of said ferrofluid and wherein said magnetic fluid is aged at room temperature or higher and at an elevated relative humidity for a sufficient time to provide said ferrofluid with a longer useful life than said ferrofluid would have without the addition of said at least one elemental modifier.

2. The composition of claim 1 wherein said elemental modifier is one of a metal, a metal mixture, a metal alloy, and a nonmetal.

3. The composition of claim 2 wherein said elemental modifier is at least one of nickel, aluminum, silicon, titanium, vanadium, chromium, manganese, iron, cobalt, copper, zinc, silver, platinum, gold, boron, dysprosium, erbium, gadolinium, germanium, holmium, indium, iridium, palladium, lead, molybdenum, neodymium, niobium, osmium, rhodium, samarium, tantalum, tin, tungsten, yttrium, zirconium, ytterbium, carbon, thulium, terbium, and praseodymium.

4. The composition of claim 3 wherein said elemental modifier is at least one of nickel, aluminum, silicon, titanium, vanadium, chromium, manganese, iron, cobalt, copper, zinc, silver, platinum, gold, dysprosium, erbium, gadolinium, samarium, yttrium, ytterbium, thulium, holmium, praseocymium, and terbium.

5. The composition of claim 4 wherein said metal is at least one of nickel, aluminum, silicon, titanium, vanadium, chromium, manganese, iron, cobalt, copper, zinc, silver, platinum, and gold.

6. The composition of claim 2 wherein said elemental modifier is one of bronze, cupro nickel, nickel chromium, nickel silver, palladium silver, zirconium nickel, titanium nickel, brass, a mix of chromium, nickel, manganese, silicon, and iron, and a mix of chromium, nickel, manganese, silicon, molybdenum, and iron.

7. The composition of claim 1 wherein said elemental modifier has a purity of about 99%.

8. The composition of claim 1 wherein said elemental modifier has a plurality of elemental modifier particles, said elemental modifier particles having a size of about one micrometer to about 170 micrometers.

9. The composition of claim 2 wherein said metal mixture has a least a first metal component and a second metal component, said first metal component and said second metal component each make up from about 10% to about 90% of said metal mixture.

10. The composition of claim 9 wherein said metal mixture has a least a first metal component and a second metal component, said first metal component and said second metal component each make up about 50% of said metal mixture.

11. A magnetic fluid composition comprising:

an oil-based, low vapor pressure carrier liquid;

a plurality of magnetic particles coated with at least one surfactant, said plurality of magnetic particles dispersed within said carrier liquid forming a ferrofluid; and at least one elemental modifier disposed without dispersant within said ferrofluid wherein said elemental modifier is at least one of a metal, a metal mixture, a metal alloy, and a nonmetal, said at least one elemental modifier being present in said ferrofluid in an amount greater than zero percent and equal to or less than ten percent by weight to the weight of said ferrofluid and wherein said magnetic fluid is aged at room temperature or higher and at an elevated relative humidity for a sufficient time to provide said ferrofluid with a longer useful life than said ferrofluid would have without the addition of said at least one elemental modifier.

12. The composition of claim 11 wherein said carrier liquid is a polar or a nonpolar liquid.

13. The composition of claim 12 wherein said carrier liquid is selected from the group consisting of a hydrocarbon-based oil, an ester-based oil and a silicone-based oil having low volatility and low viscosity.

14. The composition of claim 11 wherein said elemental modifier is at least one of nickel, aluminum, silicon, titanium, vanadium, chromium, manganese, iron cobalt, copper, zinc, silver, platinum, gold, boron, dysprosium, erbium, gadolinium, germanium, holmium, indium, iridium, palladium, lead, molybdenum, neodymium, niobium, osmium, rhodium, samarium, tantalum, tin, tungsten, yttrium, zirconium, ytterbium, carbon, thulium, terbium, and praseodymium.

15. The composition of claim 14 wherein said elemental modifier is at least one of nickel, aluminum, silicon, titanium, vanadium, chromium, manganese, iron, cobalt, copper, zinc, silver, platinum, gold, dysprosium, erbium, gadolinium, samarium, yttrium, ytterbium, thulium, holmium, praseocymium, and terbium.

16. The composition of claim 15 wherein said elemental modifier is at least one of nickel, aluminum, silicon, titanium, vanadium, chromium, manganese, iron, cobalt, copper, zinc, silver, platinum, and gold.

17. The composition of claim 11 wherein said elemental modifier is one of bronze, cupro nickel, nickel chromium, nickel silver, palladium silver, zirconium nickel, titanium nickel, brass, a mix of chromium, nickel, manganese, silicon, and iron, and a mix of chromium, nickel, manganese, silicon, molybdenum, and iron.

18. An element-modified magnetic fluid with a longer useful life obtained by the process comprising:

adding a quantity of elemental modifier without dispersant to an oil-based, low vapor pressure magnetic fluid forming a mixture;

aging said mixture at room temperature or higher and at an elevated relative humidity for a sufficient time to provide a ferrofluid with a longer useful life than said ferrofluid would have without the addition of said quantity of elemental modifier; and removing an excess of said elemental modifier from said magnetic fluid.

19. The magnetic fluid of claim 18 wherein said aging step includes aging at a temperature of at least 60° C.

20. The magnetic fluid of claim 18 wherein said aging step includes aging at a relative humidity of about 80% or higher.

21. The magnetic fluid of claim 18 wherein said aging step includes aging at a temperature of about 80° C. and relative humidity of about 90%.

22. The magnetic fluid of claim 18 wherein said aging step include aging at a temperature of about 90° C. and relative humidity of about 90%.

23. The magnetic fluid of claim 18 wherein said aging step includes aging for a period of about 2 days to about 80 days.

24. The magnetic fluid of claim 18 wherein said elemental modifier adding a step further includes adding a quantity greater than zero percent and equal to or less than ten percent by weight of said quantity of elemental modifier to said weight of said magnetic fluid.

25. A method of making an improved magnetic fluid, said method comprising:

obtaining a quantity of an oil-based, low vapor pressure magnetic fluid;

adding an amount of elemental modifier without dispersant to said quantity of magnetic fluid;

mixing said elemental modifier and said quantity of magnetic fluid forming a mixture;

aging said mixture at room temperature or higher and at an elevated relative humidity for a sufficient time to provide said magnetic fluid with a longer useful life than said magnetic fluid would have without the addition of said amount of elemental modifier; and removing excess elemental modifier from said mixture.

26. The method of claim 25 wherein said adding step includes adding a elemental modifier having a plurality of particles sized from about 1 micrometer to about 170 micrometers.

27. The method of claim 25 wherein said adding step includes selecting said elemental modifier wherein said elemental modifier is one of a metal, a metal mixture, a metal alloy, and a nonmetal.

28. The method of claim 25 wherein said adding step includes selecting said elemental modifier wherein said elemental modifier comprising at least one of nickel, aluminum, silicon, titanium, vanadium, chromium, manganese, iron, cobalt, copper, zinc, silver, platinum, gold, boron, dysprosium, erbium, gadolinium, germanium, holmium, indium, iridium, palladium, lead, molybdenum, neodymium, niobium, osmium, rhodium, samarium, tantalum, tin, tungsten, yttrium, zirconium, ytterbium, carbon, thulium, terbium, and praseodymium.

29. The method of claim 25 wherein said adding step includes selecting said elemental modifier wherein said elemental modifier comprising at least one of nickel, aluminum, silicon, titanium, vanadium, chromium, manganese, iron, cobalt, copper, zinc, silver, platinum, gold, boron, dysprosium, erbium, gadolinium, samarium, yttrium, ytterbium, thulium, holmium, praseocymium, and terbium.

30. The method of claim 25 wherein said adding step includes selecting said elemental modifier wherein said elemental modifier comprising at least one of nickel, aluminum, silicon, titanium, vanadium, chromium, manganese, iron, cobalt, copper, zinc, silver, platinum, and gold.

31. The method of claim 25 wherein said aging step includes aging at a temperature of about 60° C. or higher.

32. The method of claim 25 wherein said aging step includes aging at a relative humidity of about 80% or higher.

33. The method of claim 25 wherein said aging step includes aging at a temperature of about 80° C. and relative humidity of about 90%.

34. The method of claim 25 wherein said aging step includes aging for a period of about 2 days to about 80 days.

35. The method of claim 25 wherein said elemental modifier adding step further includes adding an amount greater than zero percent and equal to or less than ten percent by weight of said amount of said elemental modifier to said weight of said magnetic fluid.

36. A magnetic fluid composition comprising:

an oil-based, low vapor pressure carrier liquid;

a plurality of magnetic particles coated with at least one surfactant, said plurality of magnetic particles dispersed within said carrier liquid forming a ferrofluid; and at least one elemental modifier selected from the group consisting of a metal, a metal mixture, a metal alloy, and a nonmetal, wherein said metal, metal mixture, metal alloy and nonmetal is one or more of nickel, aluminum, silicon, titanium, vanadium, chromium, manganese, iron, cobalt, copper, zinc, silver, platinum, gold, boron, dysprosium, erbium, gadolinium, germanium, holmium, indium, iridium, palladium, lead, molybdenum, neodymium, niobium, osmium, rhodium, samarium, tantalum, tin, tungsten, yttrium, zirconium, ytterbium, thulium, terbium, praseodymium, bronze, cupra nickel, nickel chromium, nickel silver, palladium silver, zirconium nickel, titanium nickel, brass, a mix of chromium, nickel, manganese, silicon, and iron, and a mix of chromium, nickel, manganese, silicon, molybdenum, and iron;

said at least one elemental modifier being disposed within said ferrofluid forming a treated ferrofluid wherein said at least one elemental modifier being present in said ferrofluid in an amount greater than zero percent and equal to or less than ten percent by weight to the weight of said ferrofluid and wherein said treated ferrofluid is aged at room temperature or higher and at an elevated relative humidity for a sufficient time to provide said ferrofluid with a longer useful life than said ferrofluid would have without the addition of said at least one elemental modifier.

* * * * *

UNITED STATES PATENT AND TRADEMARK OFFICE

CERTIFICATE OF CORRECTION

PATENT NO. : 7,063,802 B2
APPLICATION NO. : 10/402527
DATED : June 20, 2006
INVENTOR(S) : Shiro Tsuda et al.

It is certified that error appears in the above-identified patent and that said Letters Patent is hereby corrected as shown below:

Column 7, line 58, in front of "Procedure for Treating Ferrofluid" the following sentence should be inserted as a new paragraph --In most treatments, the following procedure was used.--

Column 8, line 49, "forrofluids" should be changed to --ferrofluids--.

Column 23, line 43, Table 5-2B, a divisional line should be inserted between line 43, "temp. +IN - 1.2 -" and line 44, "High temp. +Dy 1.6 1,7 –" to separate data in the table 5-2B related to different experimental conditions: "Room temp." and "High temp. and humidity."

Column 25, line 51, Table 5-3B, a divisional line should be inserted between line 51," +Tb – 1.4 –" and line 52, "High temp. CFF 100A – 1.3 – 1.1" to separate data in the table 5-3B related to different experimental conditions: "Room temp." and "High temp. and humidity."

Column 27, line 62, Table 5-4B, a divisional line should be inserted between line 63, "+ Tb – 1.3 –" and line 64, "High temp. CSG 1.2 – –" to separate data in the table 5-4B related to different experimental conditions: "Room temp." and "High temp. and humidity."

Column 33, line 35, "adding a step" should be changed to --adding step--

Column 34, line 48, "cupra" should be changed to --cupro--

Signed and Sealed this

Tenth Day of October, 2006

JON W. DUDAS
*Director of the United States Patent and Trademark Office*